US008515300B2

(12) United States Patent
Fuse et al.

(10) Patent No.: US 8,515,300 B2
(45) Date of Patent: Aug. 20, 2013

(54) IMAGE FORMING APPARATUS

(75) Inventors: Takahito Fuse, Toride (JP); Takehiro Kojima, Cambridge (GB)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 12/971,733

(22) Filed: Dec. 17, 2010

(65) Prior Publication Data

US 2011/0158668 A1 Jun. 30, 2011

(30) Foreign Application Priority Data

Dec. 26, 2009 (WO) ..... PCT/JP2009/071709

(51) Int. Cl.
*G03G 15/00* (2006.01)

(52) U.S. Cl.
USPC ..... 399/49

(58) Field of Classification Search
USPC ..... 399/49, 72
See application file for complete search history.

(56) References Cited

U.S. PATENT DOCUMENTS 6,775,489 B2 * 8/2004 Tsuruya et al. ..... 399/49
6,853,817 B2 2/2005 Suzuki

FOREIGN PATENT DOCUMENTS

| | | | |
|---|---|---|---|
| JP | 2-095046 | A | 7/1990 |
| JP | 4-156479 | A | 5/1992 |
| JP | 9-160316 | A | 6/1997 |
| JP | 10-186783 | A | 7/1998 |
| JP | 11-143171 | A | 5/1999 |
| JP | 2003-076129 | A | 3/2003 |

* cited by examiner

*Primary Examiner* — Walter L Lindsay, Jr.
*Assistant Examiner* — Frederick Wenderoth
(74) *Attorney, Agent, or Firm* — Canon U.S.A., Inc., IP Division

(57) ABSTRACT

A high-density area of a low-reflectance patch image is accurately detected. There is an image forming apparatus that detects the density of a patch image by radiating light from a laser oscillator 701 and receiving reflected light reflected off the patch image using a line sensor 704. The density of a black patch image 720 having a low reflectance is detected from the difference between the position at which reflected light from a yellow patch image 710 is received and the position at which reflected light from a superimposed toner image that is transferred in such a manner that the yellow patch image 730 is superimposed on the top of the black patch image 720 is received.

35 Claims, 14 Drawing Sheets

IMAGE FORMING APPARATUS

TECHNICAL FIELD

The present invention relates to an electrophotographic or electrostatic-recording image forming apparatus such as a copying machine, a laser printer, or a facsimile machine, and more specifically to toner amount measurement and image density control.

BACKGROUND ART

In general, electrophotographic or electrostatic-recording full-color image forming apparatuses form images using four colors: yellow, magenta, cyan, and black, and mainly following two methods are known.

One is an image formation apparatus of the four-cycle method which is provided with one photosensitive member and a plurality of developing units. In this method, electrostatic latent images are sequentially formed on one photosensitive member in accordance with image information. These electrostatic latent images are developed using toner images of a plurality of colors, and the toner images of the respective colors are sequentially transferred onto an intermediate transfer belt, from which the toner images are re-transferred onto a recording sheet, or directly onto recording paper in such a manner that the toner images are superimposed on one another. Thus, a color image is formed.

The other is an image formation apparatus of the tandem method which is provided with one photosensitive member and one developing unit per color. In this method, electrostatic latent images are formed on respective photosensitive members in an image formation apparatus in accordance with image information. These electrostatic latent images are developed using toner images corresponding to the respective colors, and these toner images are sequentially transferred onto an intermediate transfer belt, from which the toner images are re-transferred onto recording paper, or directly onto recording paper so that the toner images are superimposed on one another. Thus, a color image is formed.

In the above image forming apparatuses, in order to control the density of an image to be formed, image forming conditions for forming an electrostatic latent image on a photosensitive member, such as an amount of exposed light, a developing bias, and a charging potential, are controlled. However, even if these image forming conditions are the same, the densities of images to be formed change due to influences such as changes in various quantities of state of an image forming apparatus with time, including the amount of charge of toner, the sensitivity of a photosensitive member, and transfer efficiency, and changes in environmental conditions such as temperature and humidity.

Conventionally, therefore, the density of a toner image transferred onto a photosensitive member or an intermediate transfer belt is detected, and image forming conditions such as a charging potential, an amount of exposed light, and a developing bias are feedback-controlled on the basis of the detection result.

For example, there is one in which a patch image is irradiated with light and the density of the patch image is detected based on the amount of light reflected from the patch image (the amount of reflected light) (see, for example, PTL 1).

There is another in which a density-measuring toner image borne on a photosensitive member or an intermediate transfer belt is irradiated with light and the height of the toner image is measured based on a light receiving position on a line sensor that receives reflected light from the toner image.

Here, the higher the density of the toner image is, the larger the amount of toner (the amount of adhering toner) used to form the toner image is and therefore the greater the height of the toner image is. Further, the lower the density is, the smaller the amount of toner (the amount of adhering toner) used to form the toner image is and therefore the lower the height of the toner image is. Thus, the height of a toner image measured based on a light receiving position on a line sensor is converted into density as an amount of adhering toner (see, for example, PTL 2).

CITATION LIST

Patent Literature

PTL 1 Japanese Patent Laid-Open No. 2003-76129
PTL 2 Japanese Patent Laid-Open No. 4-156479

However, in the invention described in PTL 1, there has been a problem in that because of the small amount of reflected light from a black patch image having a low reflectance, the SN ratio of reflected light is low and high-accuracy detection of density cannot be achieved.

Further, also in PTL 2, there has been a problem in that it is difficult to detect a light receiving position of a low-reflectance patch image with high accuracy and high-accuracy detection of density cannot be achieved.

More specifically, a black patch image having a low reflectance due to the light absorbing characteristic has encountered a problem in that, in particular, the amount of reflected light from the patch image decreases as the density increases and it is difficult to detect the density of the patch image.

Further, a cyan patch image has also encountered a problem in that, depending on the wavelength of light radiated from a light source, the reflectance is low and a sufficient amount of reflected light cannot be received, thus making it difficult to detect the density with high accuracy.

SUMMARY OF INVENTION

According to an aspect of the present invention, an image forming apparatus is provided capable of accurately detecting the density of even a high-density patch image formed of low-reflectance toner.

According to another aspect of the present invention, an image forming apparatus includes an image forming unit configured to form a reference toner image having a first color, and a superimposed toner image in which a toner image of the first color is superimposed on the top of a toner image having a second color with a lower reflectance than the first color, the toner image of the first color being formed under a predetermined condition under which a toner height with respect to that of the reference toner image is specified; an image bearing member configured to bear the reference toner image and the superimposed toner image that are formed by the image forming unit; an output unit configured to output a first signal corresponding to the toner height of the reference toner image formed by the image forming unit and a second signal corresponding to the toner height of the superimposed toner image formed by the image forming unit; and a toner density detecting unit configured to detect the density of the toner image having the second color included in the superimposed toner image in accordance with a difference between the first signal and the second signal output from the output unit.

Further features of the present invention will become apparent from the following description of exemplary embodiments with reference to the attached drawings.

DESCRIPTION OF EMBODIMENTS

First Embodiment

Figure 1:
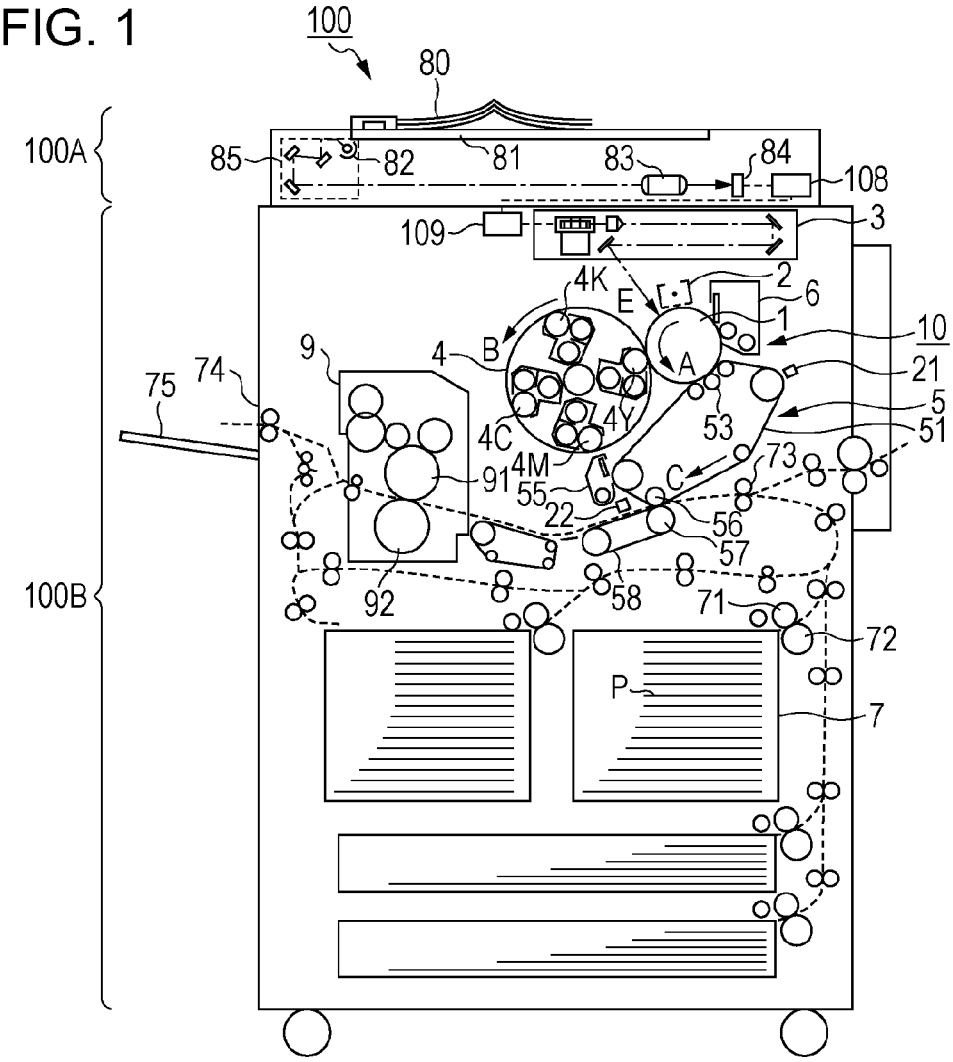
FIG. 1 is a schematic cross-sectional view illustrating an image forming apparatus of a first embodiment.

FIG. 1 illustrates an image forming apparatus used in this embodiment, which includes a printer unit 100B and a reader unit 100A mounted on the top of the printer unit 100B.

The reader unit 100A includes a document glass platen 81 on which an original document 80 is placed, an exposure lamp 82 that scans an image of the original document 80 placed on the document glass platen 81, and an image scanning unit 85 formed of mirrors. Reflected light of the original document 80 that is irradiated with light using the exposure lamp 82 is condensed by a short-focus lens array 83, is read by a full-color sensor 84 such as a CCD, and is converted into image signals corresponding to the respective colors using an image processing unit 108.

The printer unit 100B includes a photosensitive drum 1 that is driven to rotate in an arrow A direction. A charger 2, an exposure device 3, a developing device 4, a transfer device 5, a drum cleaner 6, etc. are arranged in sequence around the photosensitive drum 1 along the rotation direction thereof, and these devices collectively serve as image forming units.

The charger 2 is a corona charger that charges the photosensitive drum 1 in a non-contact manner. The charger 2 may also be implemented using a contact charger provided in contact with or in proximity to the photosensitive drum 1, such as a conductive charging roller or charging brush, or a magnetic brush.

The exposure device 3 irradiates the charged photosensitive drum 1 with exposure light E corresponding to image information to form an electrostatic latent image. In this embodiment, the image of the original document 80 is subjected to color separation into four colors: yellow, cyan, magenta, and black, and electrostatic latent images corresponding to the respective colors are sequentially formed on the photosensitive drum surface.

The developing device 4 is configured to rotate developing units 4Y, 4M, 4C, and 4K that accommodate developers of yellow, magenta, cyan, and black, in an arrow B direction by using a rotary unit. Here, the developing unit 4Y accommodates the developer of yellow, the developing unit 4M accommodates the developer of magenta, the developing unit 4C accommodates the developer of cyan, and the developing unit 4K accommodates the developer of black. On the occasion of development of an electrostatic latent image, the developing unit of the color used for development is caused to move to a development position that comes in proximity to the surface of the photosensitive drum 1, and an electrostatic latent image is visualized as a toner image.

The transfer device 5 includes an intermediate transfer belt 51, which is an endless image bearing member that is driven to rotate in an arrow C direction, a primary transfer roller 53, a secondary transfer opposing roller 56, and a secondary transfer roller 57. The primary transfer roller 53 presses against the photosensitive drum 1 with the intermediate transfer belt 51 therebetween to form a primary transfer nip portion, and the secondary transfer roller 57 presses against the secondary transfer opposing roller 56 with the intermediate transfer belt 51 therebetween to form a secondary transfer nip portion.

Further, the intermediate transfer belt 51 is provided with a belt cleaner 55 that removes toner that is not transferred onto a recording material P and that remains on the intermediate transfer belt 51.

The drum cleaner 6 is configured to remove toner on the photosensitive drum 1 by pressing a cleaning blade composed of urethane rubber or the like against the surface of the photosensitive drum 1.

The printer unit 100B includes, in addition to the above devices, a printer control unit 109 described below, a paper feed cassette 7 that accommodates the recording material P, a conveyor belt 58 that conveys the recording material P onto which toner images have been transferred from the secondary transfer nip portion, and a fixing device 9 that fixes the toner images onto the recording material P.

Further, a toner height sensor unit 21 that radiates measurement light to a patch image transferred onto the intermediate transfer belt 51 and that detects an amount in the thickness direction of the patch image (toner height (height in the direction perpendicular to the surface of the intermediate transfer belt 51)) on the basis of the position on the sensor at which the reflected light is received is provided as a device that measures the density of a toner image. The toner height detected by the toner height sensor unit 21 is converted into density through a process described below.

Next, the operation of the image forming apparatus in this embodiment will be described.

The surface of the photosensitive drum 1 is uniformly charged by the charger 2. Subsequently, when the exposure device 3 emits the exposure light E modulated in accordance with the image signal of the yellow component output from the reader unit 100A onto the photosensitive drum 1 through the mirrors, an electrostatic latent image corresponding to the image of the yellow component in the original document 80 is formed on the surface of the photosensitive drum 1.

Subsequently, the electrostatic latent image corresponding to the image of the yellow component formed on the photosensitive drum 1 is developed as a yellow toner image by the developing unit 4Y that has moved to the development position as the developing device 4 rotates in the arrow B direction.

Subsequently, when the yellow toner image enters the primary transfer nip portion in accordance with the rotation of the photosensitive drum 1 in the arrow A direction, a primary transfer voltage is applied from the primary transfer roller 53, and the yellow toner image is transferred onto the intermediate transfer belt 51. Residual toner on the photosensitive drum 1 that is not transferred onto the intermediate transfer belt 51 is removed by the drum cleaner 6.

Subsequently, the surface of the photosensitive drum 1 is uniformly charged by the charger 2. Subsequently, when the exposure device 3 emits the exposure light E modulated in accordance with the image signal of the magenta component output from the reader unit 100A onto the photosensitive drum 1, an electrostatic latent image corresponding to the image of the magenta component in the original document 80 is formed on the surface of the photosensitive drum 1.

Subsequently, the electrostatic latent image corresponding to the image of the magenta component formed on the photosensitive drum 1 is developed as a magenta toner image by the developing unit 4M that has moved to the development position as the developing device 4 rotates in the arrow B direction.

Subsequently, when the yellow toner image enters again the primary transfer nip portion in response to the rotation of the intermediate transfer belt 51 in the arrow C direction, the primary transfer voltage is applied from the primary transfer roller 53, and the magenta toner image is transferred so as to be superimposed on the top of the yellow toner image.

Similarly, a cyan toner image and a black toner image are sequentially formed on the photosensitive drum 1, and are transferred so as to be sequentially superimposed on one another at the primary transfer nip portion. Therefore, a full-color toner image is formed on the intermediate transfer belt 51.

Here, a secondary transfer voltage is not applied to the secondary transfer opposing roller 56 and the secondary transfer roller 57 until a full-color toner image is formed by sequentially superimposing the toner images of the respective colors on one another on the intermediate transfer belt 51. Thus, the toner images borne on and conveyed by the intermediate transfer belt 51 continue to be borne on the intermediate transfer belt 51 until a full-color toner image is obtained. Further, the belt cleaner 55 is located away from the intermediate transfer belt 51 with a known configuration. Thus, the toner images of the respective colors transferred onto the intermediate transfer belt 51 are not removed by the belt cleaner 55 until the toner images have been completely transferred onto the recording material P.

The full-color toner image formed on the intermediate transfer belt 51 is conveyed to the secondary transfer nip portion in accordance with the rotation of the intermediate transfer belt 51 in the arrow C direction.

Further, recording materials P are stored in the paper feed cassette 7, and are fed one-by-one by using paper feed rollers 71 and 72, and are conveyed to a registration roller 73. A recording material P conveyed to the registration roller 73 is adjusted in time and is delivered to the secondary transfer nip portion so as to be brought into contact with the full-color toner image.

When the full-color toner image on the intermediate transfer belt 51 and the recording material P enter the secondary transfer nip portion, a transfer voltage is applied to the secondary transfer roller 57, and the full-color toner image on the intermediate transfer belt 51 is transferred onto the recording material P. Toner that is not transferred onto the recording material P and that remains on the intermediate transfer belt 51 is removed by the belt cleaner 55.

The recording material P bearing the toner image is conveyed to the fixing device 9 by the conveyor belt 58, and is heated by a heater (not illustrated) while being held between and conveyed by fixing rollers 91 and 92 so that the toner image is fixed onto the recording material P.

Thereafter, the recording material P onto which the toner image has been fixed is discharged to a paper discharge tray 75 by a paper discharge roller 74.

Subsequently, the detection of the density of a toner image, which is executed by the image forming apparatus, will be described.

The photosensitive drum 1 is charged by the charger 2, and electrostatic latent images corresponding to patch images of the respective color components, yellow, magenta, cyan, and black, are formed using the exposure device 3.

The electrostatic latent images of the patch images of the respective color components formed on the photosensitive drum 1 are developed as patch images of the corresponding color components using the developing unit 4.

Subsequently, when the patch image of each color component is conveyed to the primary transfer nip portion in accordance with the rotation of the photosensitive drum 1 in the arrow A direction, a primary transfer voltage is applied from the primary transfer roller 53, and the patch image of the color component is transferred onto the intermediate transfer belt 51. When the patch image of each color component borne on the intermediate transfer belt 51 is conveyed to a position irradiated with the measurement light by the toner height sensor unit 21 (irradiation position) in accordance with the rotation of the intermediate transfer belt 51 in the arrow C direction, a light receiving position corresponding to the toner height of the patch image is measured. The light receiving position of the patch image measured in this way is converted into density through a process described below.

Hereinafter, a method in which the image forming apparatus 100 in FIG. 1 detects a density from the toner height of a yellow patch image 710 using the toner height sensor unit 21 will be described in more detail using FIGS. 2, 3, 4A, and 4B.

Figure 2:
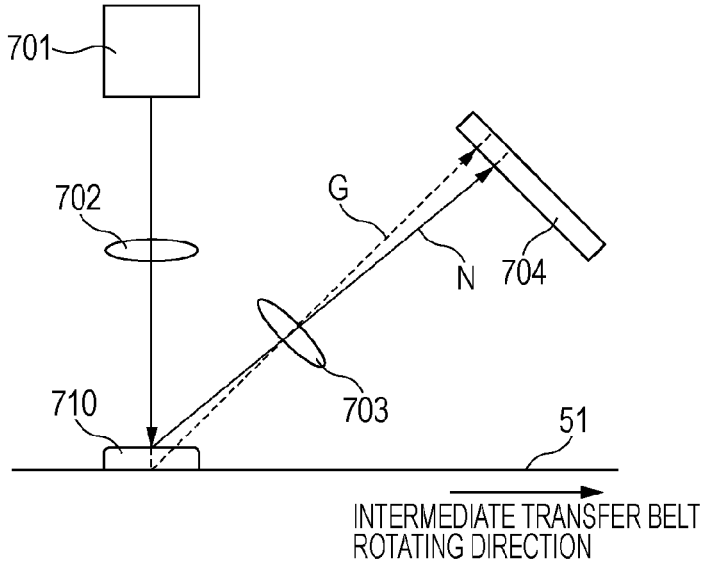
FIG. 2 is a schematic diagram of the main part of a toner height sensor unit of the first embodiment.

FIG. 2 is a schematic diagram of the main part of the toner height sensor unit 21 of this embodiment.

The toner height sensor unit 21 is configured of a laser oscillator 701 serving as an irradiating unit, a condenser lens 702, a light-receiving lens 703, and a line sensor 704 serving as a light receiving unit.

The laser oscillator 701 radiates measurement light (a wavelength of 780 [nm]) onto the intermediate transfer belt 51 through the condenser lens 702 so as to provide a spot diameter of 50 [μm].

The line sensor 704 is configured such that multiple light receiving elements are arranged in a line. Further, each of the light receiving elements of the line sensor 704 of this embodiment is configured to output a voltage corresponding to a light intensity upon receipt of light.

Subsequently, a description will be given of a method for detecting a light receiving position of the patch image 710 using the toner height sensor unit 21 in FIG. 2.

As indicated by a broken line, before the yellow patch image 710 is conveyed to the irradiation position, the measurement light radiated from the laser oscillator 701 is reflected off the surface of the intermediate transfer belt 51, and the reflected light (broken line G) is focused onto the line sensor 704 through the light-receiving lens 703. In this case, the reflected light that cannot be incident on the light-receiving lens 703 is configured to be blocked by a blocking plate (not illustrated). Note that the broken line G represents light within the reflected light from the intermediate transfer belt 51 that passes through the center of the light-receiving lens 703.

Subsequently, as indicated by a solid line, when the yellow patch image 710 is conveyed to the irradiation position, the measurement light is reflected off the surface of the patch image 710, and the reflected light (solid line N) is focused onto the line sensor 704 through the light-receiving lens 703. Note that the solid line N represents light within the reflected light from the patch image 710 that passes through the center of the light-receiving lens 703.

In this case, the position at which the reflected light from the patch image 710 (solid line N) is focused onto the line sensor 704 is different from the position at which the reflected light from the intermediate transfer belt 51 (broken line G) is focused.

The pitch between the light receiving elements may be designed so that a change of the light receiving position can be detected from the reflected light from a patch image even when the patch image has changed by an amount corresponding to one toner particle having an average particle diameter.

Further, in this embodiment, the line sensor 704 is used as a light receiving unit. However, an area sensor having light receiving elements arrayed two-dimensionally may also be used.

Further, the positional relationship between the laser oscillator 701 and the line sensor 704 is not limited to that in this embodiment. A configuration may be used in which the multiple light receiving elements of the line sensor 704 are arranged in the direction in which the light receiving position of reflected light from a patch image changes when the toner height of the patch image has changed.

More preferably, the line sensor 704 is located at a position where the line sensor 704 does not receive the specular reflection component of reflected light from the surface of the intermediate transfer belt 51 or from the surface of a patch image. In this case, any positional relationship may be used.

If the reflectance of the toner that forms a patch image is higher than the reflectance of the intermediate transfer belt 51, the amount of reflected light from the patch image increases as the density of the patch image increases. Thus, the higher the density becomes, the more accurately the light receiving position can be detected.

Figure 3:
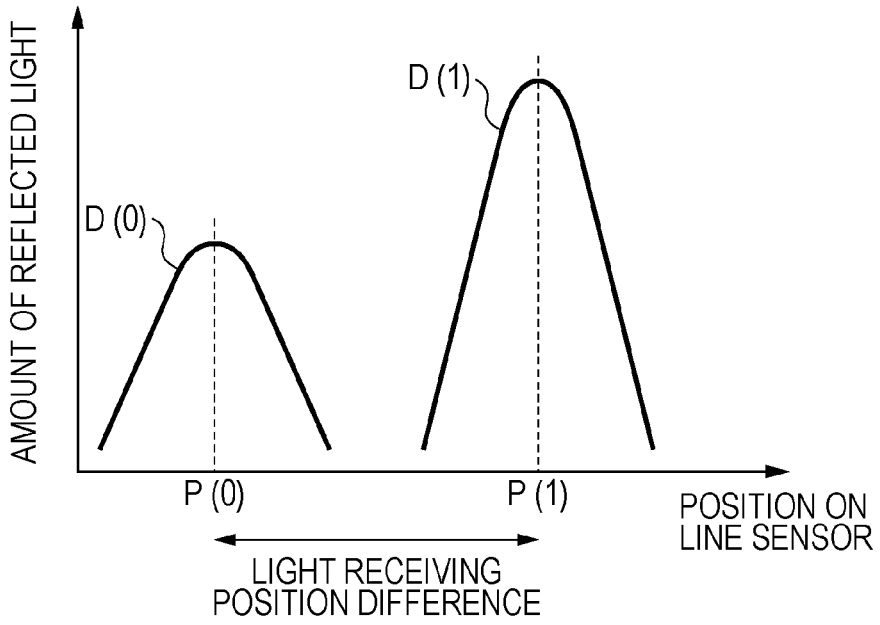
FIG. 3 is a diagram illustrating an operation for detecting a light receiving position from the light intensity of a patch image measured by the toner height sensor unit of the first embodiment.

FIG. 3 illustrates a light intensity D(0) of light reflected off the surface of the intermediate transfer belt 51 and a light intensity D(1) of light reflected off the surface of the yellow patch image 710, which are measured by the line sensor 704 in FIG. 2.

In this embodiment, the light receiving position of the reflected light from the intermediate transfer belt 51 is a position P(0) on the line sensor 704 at which the amount of reflected light from the intermediate transfer belt 51 is maximum. Further, the light receiving position of the reflected light from the yellow patch image 710 is a position P(1) on the line sensor 704 at which the amount of reflected light from the yellow patch image 710 is maximum.

The position at which the measurement light is reflected off the intermediate transfer belt 51 and the position at which the measurement light is reflected off the patch image 710 are different by an amount corresponding to the toner height of the patch image 710. Thus, the difference (light receiving position difference ΔP(1)) between the light receiving position P(0) of the intermediate transfer belt 51 and the light receiving position P(1) of the patch image 710 increases in proportion to the toner height of the patch image 710.

The light receiving position difference ΔP(1) corresponding to the toner height of the patch image 710 is detected as an amount of adhering toner using a table described below indicating a correspondence relationship between a light receiving position difference and an amount of adhering toner. The light receiving position difference ΔP(1) is calculated using Formula 1.

$$\Delta P(1)=P(1)-P(0) \quad \text{(Formula 1)}$$

Figure 4A:
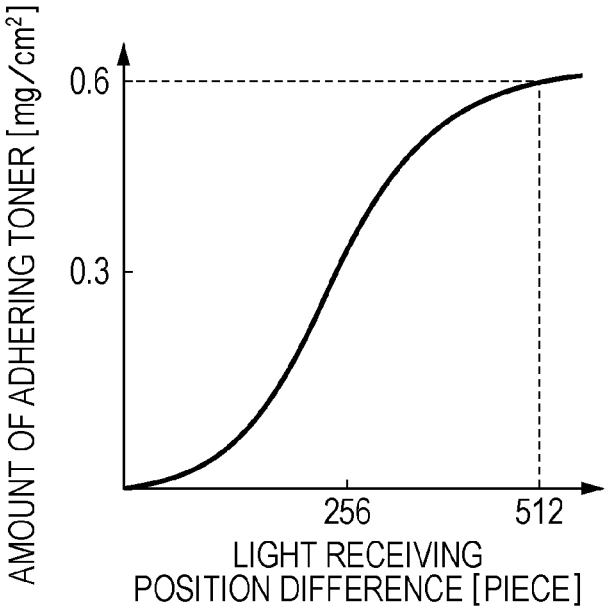
FIG. 4A is a diagram illustrating a correspondence relationship between a light receiving position difference and an amount of adhering toner.
Figure 4B:
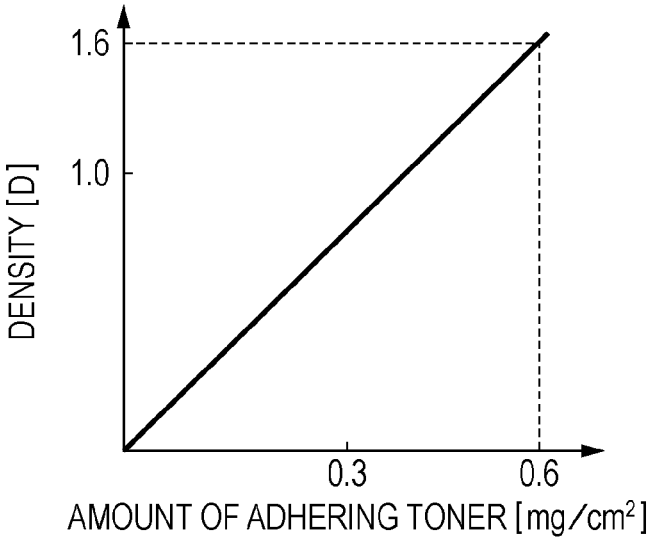
FIG. 4B is a diagram illustrating a correspondence relationship between an amount of adhering toner and a density.

FIG. 4A is a diagram representing data of a table indicating a correspondence relationship between a light receiving position difference and an amount of adhering toner, and FIG. 4B is a diagram representing data of a table indicating a correspondence relationship between an amount of adhering toner and a density for the yellow patch image 710.

The density of the patch image 710 is proportional to the amount of adhering toner, and is detected, based on the amount of adhering toner of the patch image 710 detected from the light receiving position difference described above, by referring to the table indicating the correspondence relationship between an amount of adhering toner and a density (FIG. 4B). Since the correspondence relationship between an amount of adhering toner of a patch image and a density differs from color component to color component, a table indicating a correspondence relationship between an amount of adhering toner and a density is provided for each color component.

In this embodiment, the light receiving positions P(0) and P(1) are the positions of the light receiving elements on the line sensor 704 at which the amount of reflected light from the intermediate transfer belt 51 and the amount of reflected light from the patch image 710 are maximum. However, any other configuration may be used. Curve fitting may be applied to the light intensities D(0) and D(1) measured from the output of the line sensor 704 using a method of least squares using a Gaussian function, and a position determined through a predictive arithmetic operation from parameters of the Gaussian function after fitting may be used as a light receiving position. As given in Formula 2, the Gaussian function is a function having a bell-shaped peak centered around x=μ with A as a maximum value, where μ denotes a light receiving position.

$$f(x) = \frac{A}{\sqrt{2\pi\sigma^2}}\exp\left\{-\frac{(x-\mu)^2}{2\sigma^2}\right\} + C \quad \text{(Formula 2)}$$

Further, fitting to, for example, a Lorentz function (Formula 3) or a quadratic function (Formula 4) may also be used.

$$f(x) = \frac{2A}{\pi}\cdot\frac{w}{4(x-x_c)^2+w^2} + C \quad \text{(Formula 3)}$$

$$f(x) = A(x-B)^2 + C \quad \text{(Formula 4)}$$

FIGS. 5A to 5D are diagrams illustrating the light intensities of light reflected off the yellow, magenta, cyan, and black patch images, and the light intensity of light reflected off the intermediate transfer belt 51.

Figure 5A:
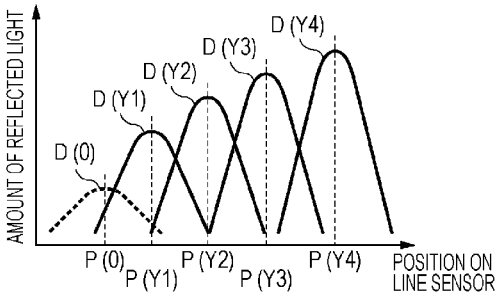
FIGS. 5A to 5D are diagrams illustrating light intensities of light reflected off patch images of respective colors measured by the toner height sensor unit of the first embodiment.

FIG. 5A illustrates light receiving positions P(Y1), P(Y2), P(Y3), and P(Y4) of light reflected off yellow patch images Y1, Y2, Y3, and Y4 having different densities, and a light receiving position P(0) of light reflected off the intermediate transfer belt 51. The densities of the yellow patch images satisfy Y1<Y2<Y3<Y4.

Figure 5B:
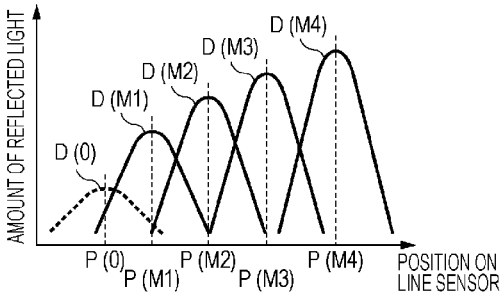

Further, FIG. 5B illustrates light receiving positions P(M1), P(M2), P(M3), and P(M4) of light reflected off magenta patch images M1, M2, M3, and M4 having different densities, and a light receiving position P(0) of light reflected off the intermediate transfer belt 51. The densities of the magenta patch images satisfy M1<M2<M3<M4.

Figure 5C:
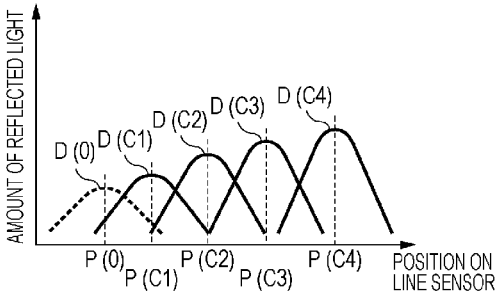

Further, FIG. 5C illustrates light receiving positions P(C1), P(C2), P(C3), and P(C4) of light reflected off cyan patch images C1, C2, C3, and C4 having different densities, and a light receiving position P(0) of light reflected off the intermediate transfer belt 51. The densities of the cyan patch images satisfy C1<C2<C3<C4.

As illustrated in FIGS. 5A to 5C, it can be seen that in the yellow, magenta, and cyan patch images, as the density increases, the light receiving position differences also increase.

Figure 5D:
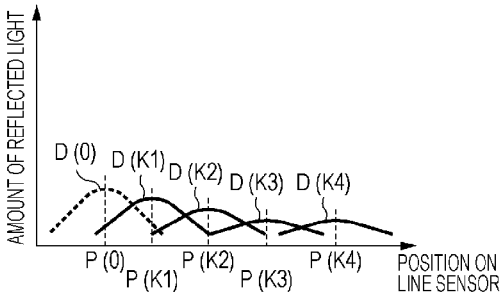
Figure 6A:
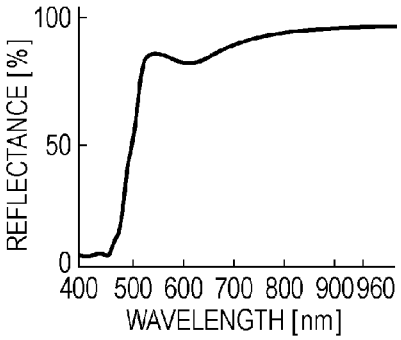
FIGS. 6A to 6D are diagrams illustrating the spectral distributions of yellow, magenta, cyan, and black.
Figure 6B:
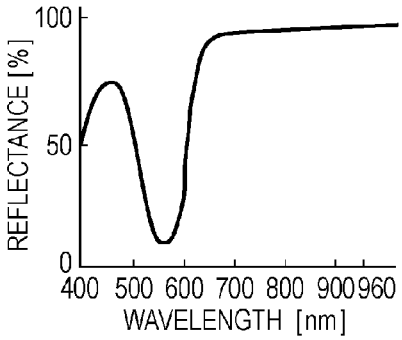
Figure 6C:
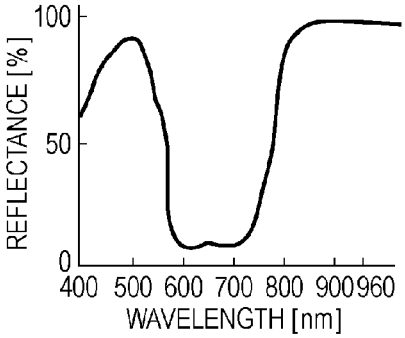
Figure 6D:
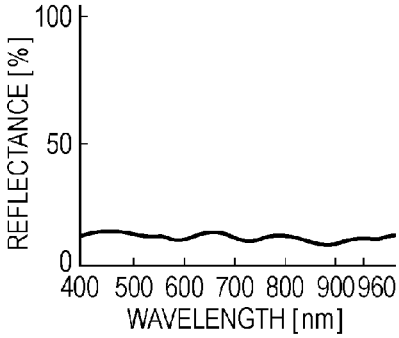

In contrast, FIG. 5D illustrates light receiving positions P(K1), P(K2), P(K3), and P(K4) of light reflected off black patch images K1, K2, K3, and K4 having different densities, and a light receiving position P(0) of light reflected off the intermediate transfer belt 51. The densities of the black patch images have the relationship K1<K2<K3<K4.

In a black patch image, due to the light absorbing properties of black toner, the amount of reflected light is small, and it is difficult to accurately detect the light receiving position. In particular, in a high-density black patch image, since the amount of adhering toner increases in proportion to the density, the amount of reflected light from the patch image decreases, and therefore the light receiving position cannot be accurately detected.

In this manner, the amount of reflected light from a black patch image is small because of the low reflectance of the black patch image with respect to the wavelength (780 [nm]) of the measurement light radiated from the toner height sensor unit 21.

FIGS. 6A to 6D illustrate spectral distributions of yellow, magenta, cyan, and black toners, respectively. The reflectances with respect to the measurement light used in this embodiment (a wavelength of 780 [nm]) are approximately 90 [%] (FIG. 6A, FIG. 6B) for the yellow and magenta toners, approximately 50 [%] (FIG. 6C) for the cyan toner, and approximately 10 [%] (FIG. 6D) for the black toner.

Accordingly, in this embodiment, the light receiving position difference between a light receiving position of reflected light from a yellow patch image serving as a reference toner image having a first color and a light receiving position of reflected light from the intermediate transfer belt 51 (the light receiving position difference of the yellow patch image) is detected. Subsequently, a yellow patch image formed under the same image forming conditions as those of the yellow patch image for which the light receiving position has been detected is superimposed on the top of a patch image of black serving as a second color to form a superimposed toner image. Subsequently, the light receiving position difference between a light receiving position of reflected light from the superimposed toner image and the light receiving position of the reflected light from the intermediate transfer belt 51 (the light receiving position difference of the superimposed toner image) is detected. The light receiving position difference between a light receiving position of reflected light from the black patch image and the light receiving position of reflected light from the intermediate transfer belt 51 is calculated from the difference between the light receiving position difference of the yellow patch image and the light receiving position difference of the superimposed toner image.

The superimposed toner image formed by superimposing the yellow patch image on the top of the black patch image has a large amount of reflected light because the radiated measurement light is reflected off the yellow patch image in the superimposed toner image, and the light receiving position thereof can also be accurately detected.

Therefore, even for a black patch image having a low reflectance, an amount of adhering toner or a density converted from the amount of adhering toner can be detected from the calculated light receiving position difference of the black patch image using the method described above.

Subsequently, a method for superimposing a toner image having a first color on the top of a toner image having a second color to form a superimposed toner image using the toner height sensor unit 21 of this embodiment, and a method for detecting a light receiving position of the superimposed toner image will be described in detail using FIGS. 7A to 7D, 8, and 9. In the description of FIGS. 7A to 7D, 8, and 9, the toner image having the first color is the yellow patch image 710, and the toner image having the second color is a black patch image 720. Further, a superimposed toner image 730 is produced by superimposing the yellow patch image 710 on the top of the black patch image 720.

FIGS. 7A to 7D are cross-sectional views of the main part of the image forming apparatus 100 of this embodiment.

Figure 7A:
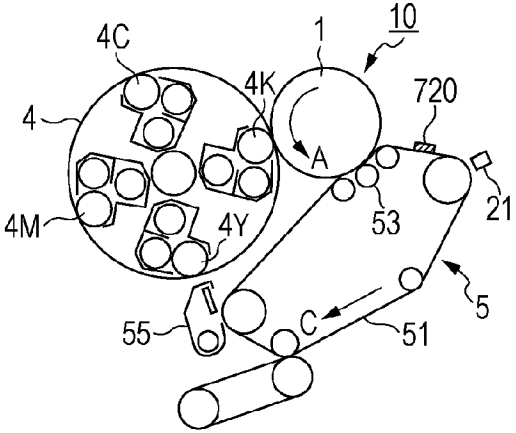
FIGS. 7A to 7D are diagrams illustrating an operation when the image forming apparatus of the first embodiment forms a superimposed toner image.

First, the black patch image 720 formed on the photosensitive drum 1 by the developing unit 4K is transferred onto the intermediate transfer belt 51 at the primary transfer nip portion. Subsequently, the black patch image 720 is conveyed to the irradiation position of the toner height sensor unit 21 in accordance with the rotation of the intermediate transfer belt 51 in the arrow C direction (FIG. 7A). At this time, the toner height sensor unit 21 does not radiate measurement light to the black patch image 720.

Figure 7B:
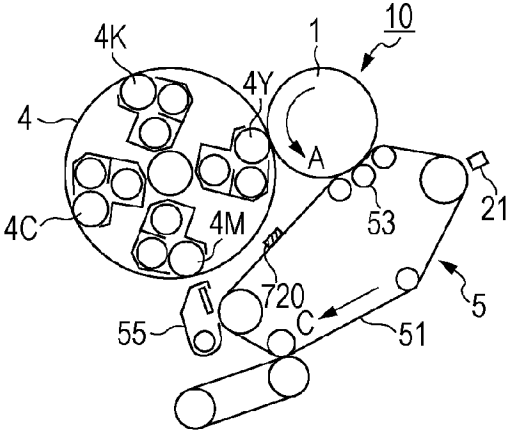

While the black patch image 720 is conveyed to the secondary transfer nip portion in accordance with the rotation of the intermediate transfer belt 51 in the arrow C direction, a secondary transfer voltage is not applied to the secondary transfer roller 57 and the secondary transfer opposing roller 56. Further, the belt cleaner 55 is located away from the intermediate transfer belt 51 in a manner similar to that when a full-color toner image is formed. Therefore, the black patch image 720 is again conveyed to the primary transfer nip portion while maintaining the toner height (FIG. 7B).

Figure 7C:
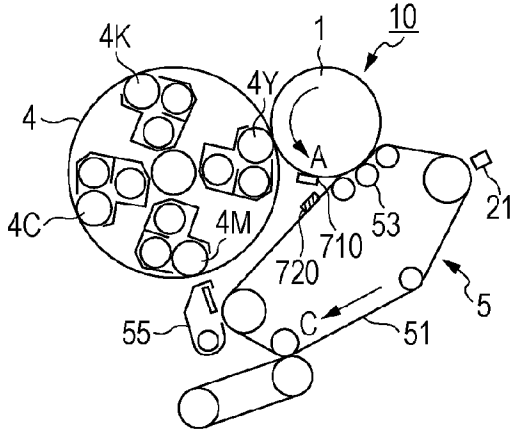

Subsequently, the yellow patch image 710 serving as a reference toner image having the first color is formed on the photosensitive drum 1 by the developing unit 4Y so as to be superimposed on the black patch image 720 that is borne on and conveyed by the intermediate transfer belt 51 (FIG. 7C).

Figure 7D:
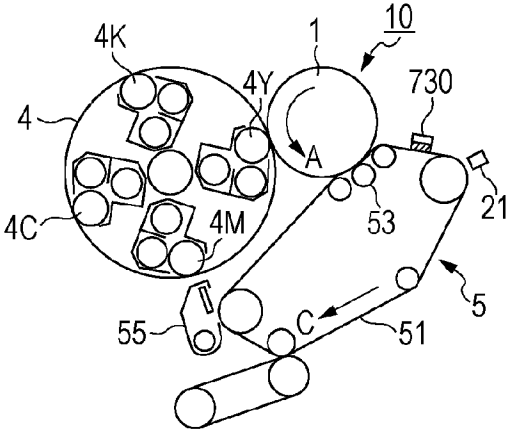

Subsequently, the yellow patch image 710 is transferred so as to be superimposed on the top of the black patch image 720 at the primary transfer nip portion, and therefore the superimposed toner image 730 is formed (FIG. 7D).

Next, a method for detecting the light receiving position difference P(3) of the superimposed toner image 730 will be described using FIG. 8.

In the toner height sensor unit 21, when the superimposed toner image 730 is located at a position indicated by a broken line, the laser oscillator 701 irradiates the intermediate transfer belt 51 with measurement light, and the light reflected off the intermediate transfer belt 51 is focused at a position P(0) on the line sensor 704. In this case, the broken line G in FIG. 8 represents reflected light within the light reflected from the surface of the intermediate transfer belt 51 that passes through the center of the light-receiving lens 703.

Subsequently, when the superimposed toner image 730 is conveyed to a position indicated by a solid line in accordance with the rotation of the intermediate transfer belt 51 in the arrow C direction, the measurement light radiated from the laser oscillator 701 is reflected off the superimposed toner image 730, and this light is focused at a position P(3) on the line sensor 704. In this case, the solid line H in FIG. 8 represents reflected light within the light reflected off the yellow toner (yellow patch image 710) serving as the surface of the superimposed toner image 730 that passes through the center of the light-receiving lens 703.

Figure 8:
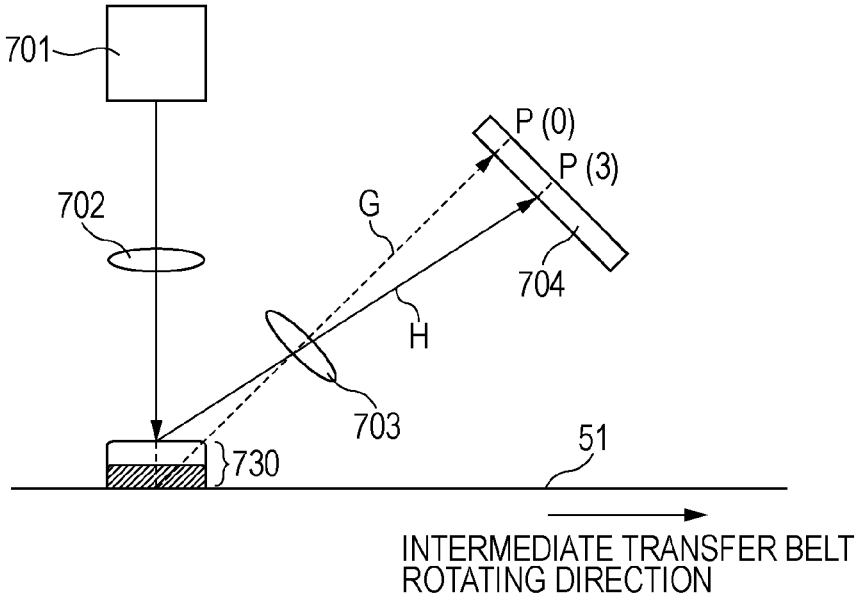
FIG. 8 is a schematic diagram of the main part of the toner height sensor unit that radiates measurement light to a superimposed toner image.
Figure 9:
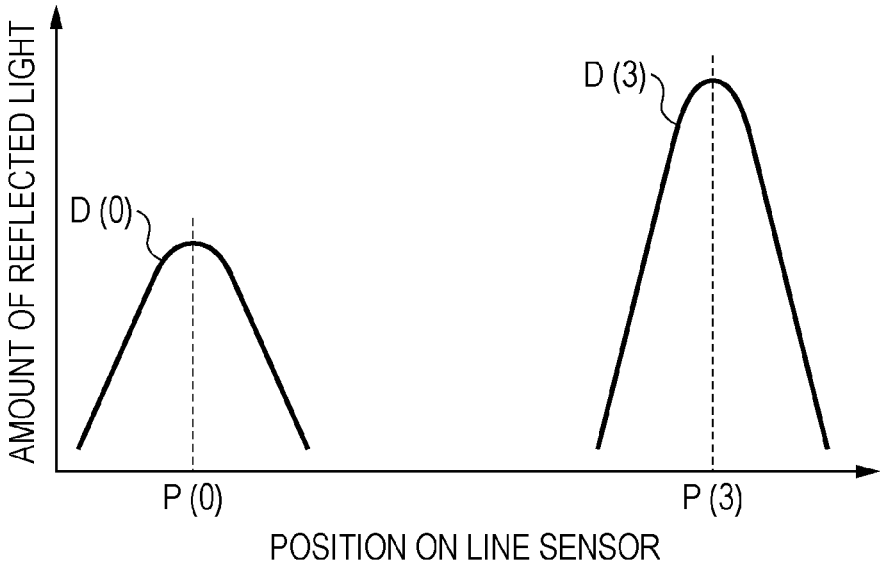
FIG. 9 is a diagram illustrating light intensities of the superimposed toner image measured by the toner height sensor unit of the first embodiment.

FIG. 9 illustrates a light intensity D(0) of reflected light from the intermediate transfer belt 51 and a light intensity D(3) of reflected light from the superimposed toner image 730, which are measured by the toner height sensor unit 21 in FIG. 8.

From FIG. 9, the surface of the superimposed toner image 730 corresponds to the yellow toner (yellow patch image 710), and therefore it is possible to detect the light receiving position P(3) of light reflected off the superimposed toner image 730 from the light intensity D(3) of light reflected off the superimposed toner image 730.

The toner height of the superimposed toner image 730 is equal to the sum of the toner height of the black patch image 720 and the toner height of the yellow patch image 710. That is, the light receiving position difference ΔP(2) of the black patch image is measured at a light receiving position where the light receiving position of light reflected off the surface of the superimposed toner image 730 changes from the light receiving position of light reflected off the yellow patch image 710 by an amount corresponding to the toner height of the black patch image.

Thus, the light receiving position difference ΔP(2) of the black patch image 720 can be calculated using Formulas 5 and 6 based on the light receiving position P(3) of light reflected off the superimposed toner image 730.

The light receiving position difference ΔP(3) of light reflected off the superimposed toner image 730 is calculated using Formula 6 from the light receiving position P(3) of light reflected off the superimposed toner image described above and the light receiving position P(0) of light reflected off the intermediate transfer belt 51. Further, the light receiving position difference ΔP(1) of light reflected off the yellow patch image 710 is calculated using Formula 1 from the light receiving position P(1) of light reflected off the yellow patch image 710, which has been separately formed in a single-color state, and the light receiving position P(0) of light reflected off the intermediate transfer belt 51. The light receiving position difference ΔP(2) of the black patch image 720 is a light receiving position difference of the black patch image 720 that is indirectly measured through the formation of the superimposed toner image 730.

$$\Delta P(2)=\Delta P(3)-\Delta P(1) \quad \text{(Formula 5)}$$

$$\Delta P(3)=P(3)-P(0) \quad \text{(Formula 6)}$$

The amount of adhering toner of the black patch image 720 may be detected, based on the light receiving position difference ΔP(2) of the black patch image, using the table illustrated in FIG. 4A representing a correspondence relationship between a light receiving position difference and an amount of adhering toner. Further, the density of the black patch image 720 may be detected, from the amount of adhering toner of the black patch image 720, using a table representing a correspondence relationship between an amount of adhering toner and a density corresponding to the black patch image.

Hereinafter, density control in this embodiment will be described.

The image forming apparatus of this embodiment provides representation of the shading of an image using 256 grayscale levels (0 to 255). Thus, when density control is implemented using patch images, 16 patch images are formed for each color. The densities of the 16 patch images are represented in steps of 16 levels such as 15, 31, . . . , 239, and 255. Hereinafter, 16 yellow patch images T(Ya), T(Yb), . . . , and T(Yp) are collectively referred to as T(Yx). In this regard, a, b, . . . , and p mean that the density levels are 15, 31, . . . , and 255. Similarly, magenta patch images T(Ma), T(Mb), . . . , and T(Mp) are referred to as T(Mx), cyan patch images T(Ca), T(Cb), . . . , and T(Cp) are referred to as T(Cx), and black patch images T(Ka), T(Kb), . . . , and T(Kp) are referred to as T(Kx).

Note that the number of patch images and the density levels are appropriately determined and are not limited to those in this embodiment.

Figure 10:
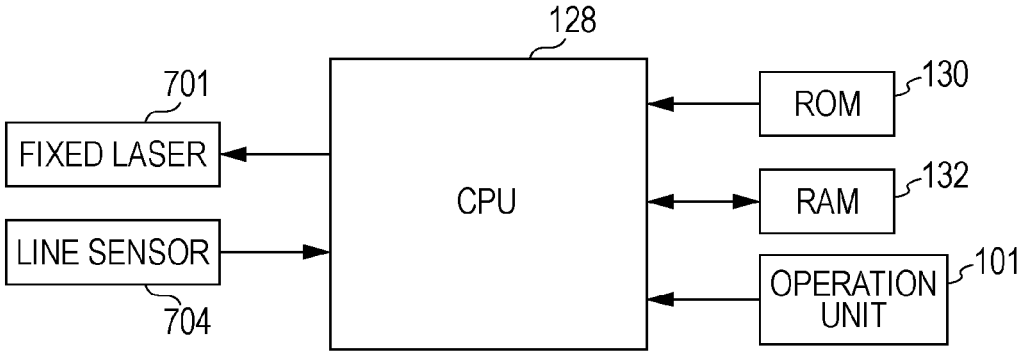
FIG. 10 is a control block diagram of the image forming apparatus of the first embodiment.
Figure 11:
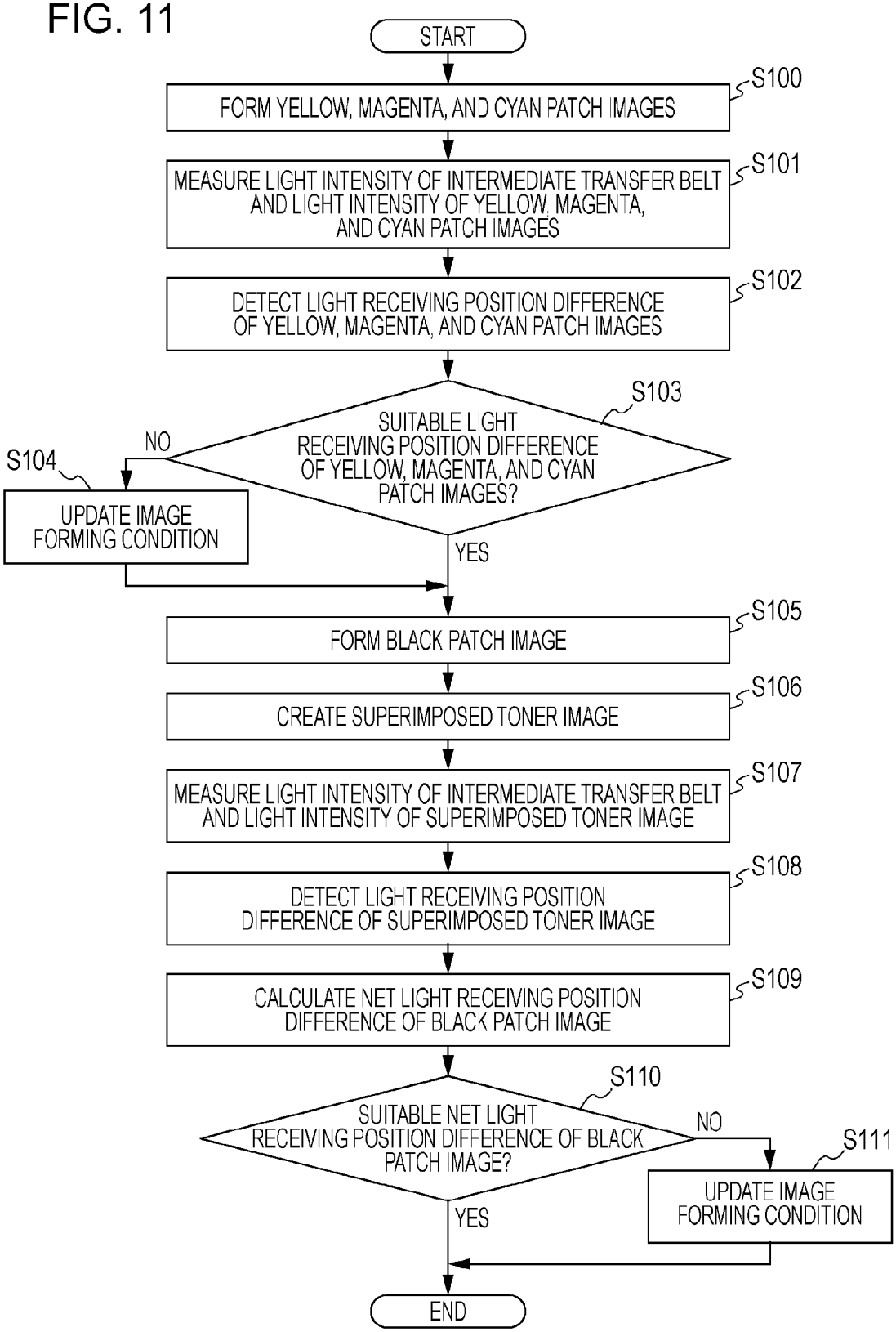
FIG. 11 is a flowchart diagram illustrating density control for controlling image forming conditions of the first embodiment.

Here, FIG. 10 is a control block diagram of the image forming apparatus of this embodiment. Further, FIG. 11 is a flowchart describing the operation of a CPU when density control is implemented using the toner height sensor unit 21, which includes a process for detecting the density of the black patch images T(Kx) in this embodiment.

In FIG. 10, a CPU 128 is a control circuit that controls the overall image forming apparatus. A ROM 130 stores a control program for controlling various processes executed by the image forming apparatus. A RAM 132 is a system work memory used by the CPU 128 to perform processes.

Further, the ROM 130 or RAM 132 of this embodiment stores image forming conditions described below for forming yellow, magenta, cyan, and black toner images. The image forming conditions stored in the ROM 130 are used in density control immediately after the main power of the image forming apparatus is turned on, and are stored in advance at the time of factory shipment. Further, the image forming conditions stored in the RAM 132 are used in the second and subsequent density controls after the main power of the image forming apparatus is turned on, and are updated each time density control is executed.

The laser oscillator 701 radiates measurement light onto the intermediate transfer belt 51 in accordance with a signal from the CPU 128.

When the line sensor 704 receives reflected light from the intermediate transfer belt 51 and reflected light from a patch image borne on the intermediate transfer belt 51, a position on the line sensor 704 at which a maximum amount of reflected light is obtained, which is measured by each light receiving element, is detected as a light receiving position by using the CPU 128.

An operation unit 101 is an operation panel provided on the main body of the image forming apparatus 100 illustrated in FIG. 1, and is used by a user to input various conditions for forming an image. A user performs a predetermined input through the operation panel, thereby outputting a signal for causing the toner height sensor unit 21 to execute density control to the CPU 128. The operation unit 101 may be a keyboard of a PC connected to the image forming apparatus via a network, and may be configured to output a signal for causing the toner height sensor unit 21 to execute density control to the CPU 128 in response to a predetermined input.

When a signal for causing the toner height sensor unit 21 to execute density control is input from the operation unit 101, the CPU 128 executes the control illustrated in the flowchart of FIG. 11. Alternatively, the CPU 128 may be configured to execute the control illustrated in the flowchart of FIG. 11 after image formation has been executed a predetermined number of times, or may be configured to execute the control illustrated in the flowchart of FIG. 11 after the main power of the image forming apparatus 100 (FIG. 1) is turned on.

The process of the flowchart is executed by the CPU 128 by reading a program stored in the ROM 130.

Hereinafter, density control implemented by the image forming apparatus of this embodiment will be described in detail using the schematic cross-sectional view of the image forming apparatus in FIG. 1 and the flowchart given in FIG. 11.

First, the CPU 128 controls the image forming apparatus 100 to form yellow, magenta, and cyan patch images T(Yx), T(Mx), and T(Cx) on the intermediate transfer belt 51 using the yellow, magenta, and cyan image forming conditions (S100).

Figure 12:
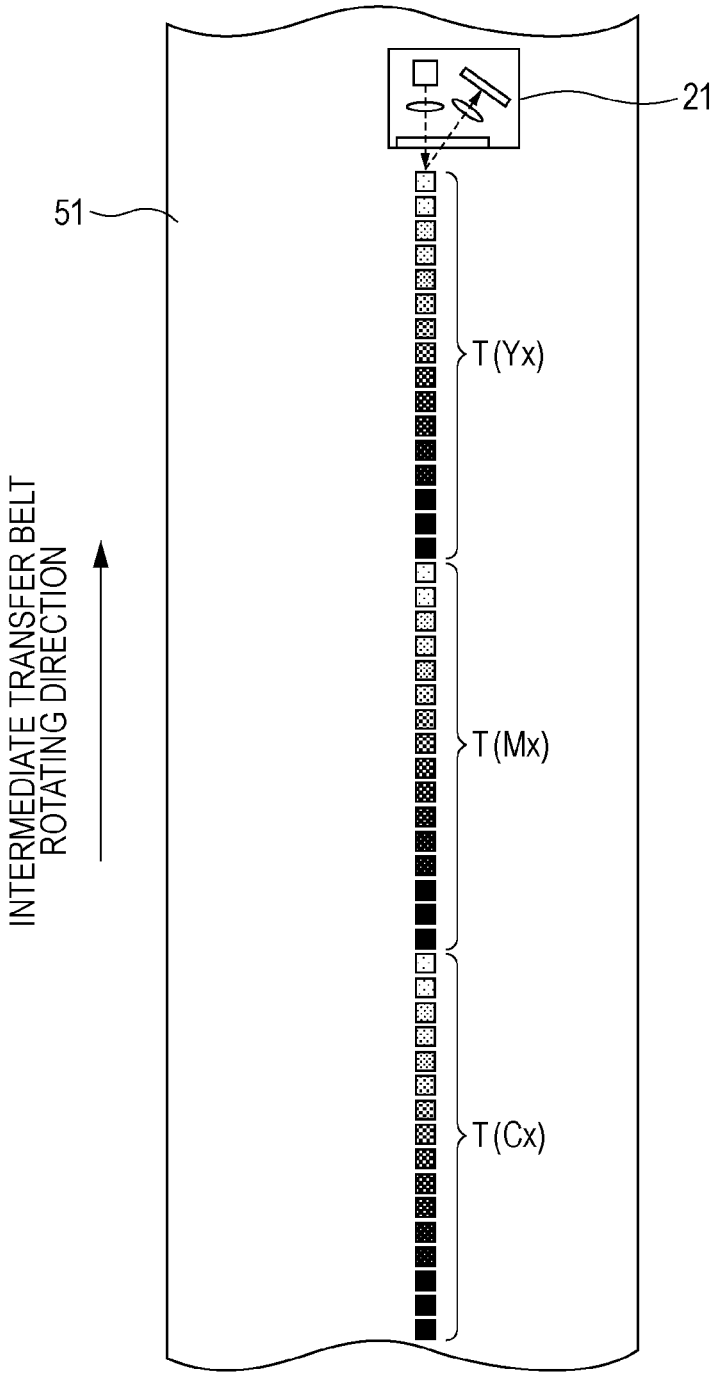
FIG. 12 is a schematic diagram of patch images borne on an intermediate transfer belt 51.

The manner in which the patch images formed in step S100 have been transferred onto the intermediate transfer belt 51 is illustrated in FIG. 12. On the intermediate transfer belt 51, the patch images T(Yx), T(Mx), and T(Cx) are formed at a predetermined interval along the rotation direction (arrow C direction) of the intermediate transfer belt 51. The predetermined interval is a distance larger than the spot diameter of the measurement light radiated from the laser oscillator 701.

The patch images T(Yx), T(Mx), and T(Cx) formed on the intermediate transfer belt 51 are sequentially conveyed to the irradiation position of the toner height sensor unit 21 in accordance with the rotation of the intermediate transfer belt 51 in the arrow C direction.

Subsequently, the CPU 128 causes the toner height sensor unit 21 to detect the light receiving position P(0) of light reflected off the intermediate transfer belt 51 and the light receiving positions P(Yx), P(Mx), and P(Cx) of light reflected off the patch images T(Yx), T(Mx), and T(Cx) (S101).

In step S101, the CPU 128 causes the laser oscillator 701 to radiate measurement light onto the intermediate transfer belt 51, and samples a signal of an amount of reflected light output from the line sensor 704 at a predetermined period.

Therefore, the CPU 128 measures the light intensities D(Yx), D(Mx), and D(Cx) of light reflected off the respective patch images T(Yx), T(Mx), and T(Cx), and the two light intensities D(0) of light reflected off the intermediate transfer belt 51 per patch image. Subsequently, the CPU 128 detects the light receiving position P(0) of the intermediate transfer belt 51 and the light receiving positions P(Yx), P(Mx), and P(Cx) of the patch images T(Yx), T(Mx), and T(Cx) from the light intensities D(0), D(Yx), D(Mx), and D(Cx), respectively, using the method described above.

Here, the light receiving position P(0) in this embodiment is the average of the light receiving position of the intermediate transfer belt 51 that is a predetermined distance away in the conveyance direction from a leading end in the conveyance direction of one patch image and the light receiving position of the intermediate transfer belt 51 that is a predetermined distance away in the direction opposite to the conveyance direction from a trailing end in the conveyance direction of the one patch image. That is, averaging of the light receiving positions of reflected light from the intermediate transfer belt 51 on the upstream and downstream sides in the conveyance direction of the patch images T(Yx), T(Mx), and T(Cx) mitigates errors caused by variations in the thickness of the intermediate transfer belt 51 or loosening of the intermediate transfer belt 51.

Subsequently, the CPU 128 calculates the light receiving position differences ΔP(Yx), ΔP(Mx), and ΔP(Cx) using Formulas 7 to 9 based on the light receiving positions P(0), P(Yx), P(Mx), and P(Cx) measured in step S101 (S102).

$$\Delta P(Yx)=P(Yx)-P(0)\ (x=a, b, \ldots, p) \quad \text{(Formula 7)}$$

$$\Delta P(Mx)=P(Mx)-P(0)\ (x=a, b, \ldots, p) \quad \text{(Formula 8)}$$

$$\Delta P(Cx)=P(Cx)-P(0)\ (x=a, b, \ldots, p) \quad \text{(Formula 9)}$$

Subsequently, the CPU 128 determines whether or not the light receiving position differences ΔP(Yx), ΔP(Mx), and ΔP(Cx) are equal to target values $\Delta P_T(Yx)$, $\Delta P_T(Mx)$, and $\Delta P_T(Cx)$ stored in advance in the ROM 130 (S103). Here, the term target value is a light receiving position difference detected from a patch image having a suitable density level, and is stored in advance in the ROM 130.

Here, the CPU 128 may be configured to detect the amounts of adhering toner Q(Yx), Q(Mx), and Q(Cx) of the respective patch images from the light receiving position differences ΔP(Yx), ΔP(Mx), and ΔP(Cx) using a table representing a correspondence relationship between a light receiving position difference and an amount of adhering toner. Here, Q(Yx) is the amount of adhering toner of the yellow patch image T(Yx), Q(Mx) is the amount of adhering toner of the magenta patch image T(Mx), and Q(Cx) is the amount of adhering toner of the cyan patch image T(Cx).

Further, the CPU 128 may also be configured to detect the densities of the patch images T(Yx), T(Mx), and T(Cx) using a table representing a correspondence relationship between an amount of adhering toner and a density for each of the patch images T(Yx), T(Mx), and T(Cx). That is, the CPU 128 and these tables also function as a density detecting unit.

If in step S103, the light receiving position differences ΔP(Yx), ΔP(Mx), and ΔP(Cx) are not equal to the target values $\Delta P_T(Yx)$, $\Delta P_T(Mx)$, and $\Delta P_T(Cx)$, the CPU 128 controls the yellow, magenta, and cyan image forming conditions (S104). Here, the image forming conditions are a charging voltage, a developing bias, a primary transfer voltage, a lookup table, and so on. Control of the image forming conditions is similar to existing density control, and the detailed descriptions thereof are omitted.

In step S104, the CPU 128 stores the changed yellow, magenta, and cyan image forming conditions in the RAM 132, and then proceeds to step S105. Therefore, the light receiving position differences of patch images formed using the image forming conditions stored in the RAM 132 have values equal to the target values.

On the other hand, if in step S103, the light receiving position differences ΔP(Yx), ΔP(Mx), and ΔP(Cx) of the yellow, magenta, and cyan patch images are equal to the target values $\Delta P_T(Yx)$, $\Delta P_T(Mx)$, and $\Delta P_T(Cx)$, the CPU 128 proceeds to step S105 without controlling the image forming conditions.

In step S105, the CPU 128 controls the image forming apparatus to form a black patch image T(Kx) on the intermediate transfer belt 51 using the black image forming conditions.

The black patch image T(Kx) formed on the intermediate transfer belt 51 passes through the irradiation position of the toner height sensor unit 21 and is again conveyed to the primary transfer nip portion in accordance with the rotation of the intermediate transfer belt 51 in the arrow C direction.

Subsequently, the CPU 128 forms a superimposed toner image T(supx) using the yellow image forming conditions stored in the ROM 130 or the RAM 132 (S106). Here, superimposed toner images T(supx) are formed in such a manner that a yellow patch image T(Yh) having a density level of 127, which is the reference toner image, is superimposed on the top of black patch images T(Kx) having density levels of 15, 31, . . . , and 255. That is, T(suph) is a superimposed toner image in which the reference toner image (yellow patch image having a density level of 127) is transferred so as to be superimposed on the top of a black patch image T(Kh) having a density level of 127.

In step S106, the superimposed toner images T(supx) borne on the intermediate transfer belt 51 are sequentially conveyed to the irradiation position of the toner height sensor unit 21 in accordance with the rotation of the intermediate transfer belt 51 in the arrow C direction.

Subsequently, the CPU 128 causes the toner height sensor unit 21 to detect the light receiving position P(0) of light reflected off the intermediate transfer belt 51 and light receiving positions P(supx) of light reflected off the superimposed toner images T(supx) (S107).

In step S107, similarly to step S101, the CPU 128 causes the laser oscillator 701 to radiate measurement light onto the intermediate transfer belt 51 through the condenser lens 702, and samples a signal of an amount of reflected light output from the line sensor 704 at a predetermined period.

Therefore, the CPU 128 measures the light intensity D(supx) of light reflected off each of the superimposed toner images T(supx) and the two light intensities D(0) of light reflected off the intermediate transfer belt 51 per superimposed toner image. Subsequently, the CPU 128 detects the light receiving position P(0) of the intermediate transfer belt 51 and the light receiving position P(supx) of the superimposed toner image T(supx) from the light intensities D(0) and D(supx), respectively, using the method described above.

In this embodiment, similarly to step S101, the light receiving position P(0) is the average of the light receiving positions of reflected light from the intermediate transfer belt 51 on the upstream and downstream sides in the direction in which one superimposed toner image T(supx) is conveyed.

Subsequently, the CPU 128 calculates a light receiving position difference ΔP(supx) using Formula 10 from the light receiving positions P(0) and P(supx) measured in step S107 (S108).

$$\Delta P(\text{sup}x)=P(\text{sup}x)-P(0)\ (x=a, b, \ldots, p) \qquad \text{(Formula 10)}$$

Subsequently, the CPU 128 calculates a light receiving position difference ΔP(Kx) of the black patch image from the difference (Formula 11) between the light receiving position difference ΔP(supx) of the superimposed toner image and a target value $\Delta P_I$(Yh) stored in the ROM 130 (S109). Here, since a light receiving position difference ΔP(Yh) of the yellow patch image having a density level of 127 is equal to the target value $\Delta P_I$(Yh) through steps S100 to S104, the target value stored in advance in the ROM 130 is used.

$$\Delta P(Kx)=\Delta P(\text{sup}x)-\Delta P_I(Yh)\ (x=a, b, \ldots, p) \qquad \text{(Formula 11)}$$

Subsequently, the CPU 128 determines whether or not the light receiving position difference ΔP(Kx) of the black patch image is equal to the target value $\Delta P_I$(Kx) stored in advance in the ROM 130 (S110).

Here, the CPU 128 may be configured to detect the amount of adhering toner Q(Kx) of the black patch image from the light receiving position difference ΔP(Kx) using a table representing a correspondence relationship between a light receiving position difference and an amount of adhering toner.

Further, the CPU 128 may also be configured to detect the density of the black patch image T(Kx) using a table representing a correspondence relationship between an amount of adhering toner and a density for the black patch image T(Kx).

If in step S110, the light receiving position difference ΔP(Kx) of the black patch image is equal to the target value $\Delta P_I$(Kx), density control performed by the toner height sensor unit 21 is terminated.

On the other hand, if in step S110, the light receiving position difference ΔP(Kx) is not equal to the target value $\Delta P_I$(Kx), the CPU 128 controls the black image forming conditions (S111). Here, similarly to step S104, control of the image forming conditions is similar to existing density control, and the detailed descriptions thereof are omitted.

In step S111, the CPU 128 stores the changed black image forming conditions in the RAM 132, and then terminates the density control performed by the toner height sensor unit 21.

An update of a lookup table, which is one of the image forming condition control methods executed in steps S104 and S111, will be described using FIGS. 13A and 13B.

Figure 13A:
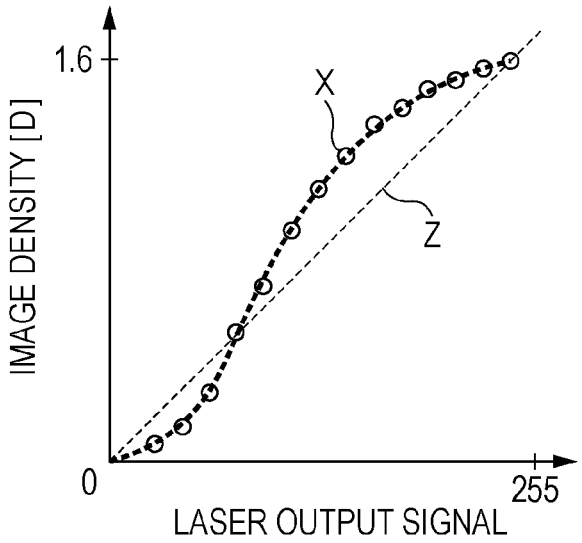
FIG. 13A is a diagram illustrating a printer-unit output characteristic.
Figure 13B:
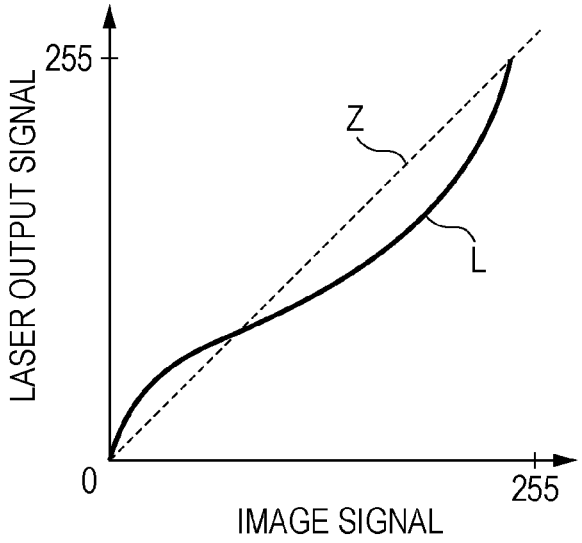
FIG. 13B is a diagram illustrating a lookup table.

FIG. 13A is a printer-unit output characteristic representing the correspondence relationship between image signals for forming images having individual grayscale levels stored in the ROM 130 and the densities of images formed in accordance with the image signals.

In FIG. 13A, a curve X represents a printer-unit output characteristic detected from an arbitrary patch image, and a straight line Z represents an ideal printer-unit output characteristic detected from a patch image formed under appropriate image forming conditions. Further, FIG. 13B is a lookup table (curve L) for converting the printer-unit output characteristic (curve X) of the arbitrary patch image in FIG. 13A into the ideal printer-unit output characteristic (straight line Z).

In this embodiment, a current printer-unit output characteristic is created using image densities determined from the light receiving position differences ΔP(Yx), ΔP(Mx), ΔP(Cx), and ΔP(Kx), and a lookup table for changing the printer-unit output characteristic to an ideal printer-unit output characteristic is created using a known method. Since only 16 pieces of data of image densities of patch images having the respective density levels are detected for each color, the current printer-unit output characteristic is an approximated curve calculated from the respective pieces of data.

While the description has been given of a method for controlling image forming conditions by updating a lookup table, control of image forming conditions in this embodiment is not limited to that in the above configuration. The CPU 128 may be configured to, as control of image forming conditions in this embodiment, update a lookup table after changing the charging voltage and the developing bias by a predetermined amount stored in advance in the ROM 130. Or the CPU 128 may be configured to select a suitable lookup table from a plurality of lookup tables stored in advance in the ROM 130. Alternatively, the CPU 128 may also be configured to change the primary transfer voltage by a predetermined amount stored in advance in the ROM 130.

Second Embodiment

This embodiment is different from the first embodiment described above in terms of the following points. Other elements in this embodiment are the same as the corresponding ones in the first embodiment described above, and the descriptions thereof are omitted.

In the first embodiment, the light intensity of reflected light from a patch image on the intermediate transfer belt 51 is measured using the toner height sensor unit 21 (FIG. 1). In this embodiment, in contrast, after a patch image borne on the intermediate transfer belt 51 is transferred onto a recording material P using a toner height sensor unit 22 (FIG. 1), the light intensity of reflected light from the patch image transferred onto the recording material P is measured.

The toner height sensor unit 22 is disposed in a conveying path of the recording material P, which extends from the secondary transfer nip portion to the fixing device 9, and radiates measurement light to the recording material P conveyed to the fixing device 9 in accordance with the rotation of the conveyor belt 58 and a toner image transferred onto the recording material P at the secondary transfer nip portion.

Here, when a superimposed toner image T(supx) borne on the recording material P is conveyed to the irradiation position of the toner height sensor unit 22, the surface of the superimposed toner image T(supx) needs to be a yellow toner image T(Yh).

Thus, when the toner height sensor unit 22 that radiates measurement light to a toner image transferred onto the recording material P is used, the superimposed toner image T(supx) borne on the intermediate transfer belt 51 before transferred onto the recording material P is different from that in the first embodiment. Specifically, the superimposed toner image T(supx) formed on the intermediate transfer belt 51 is that in which a black patch image T(Kx) serving as a toner image having a second color is superimposed on the top of the yellow patch image T(Yh) serving as a reference toner image having a first color.

When the superimposed toner image T(supx) is transferred onto the recording material P, the superimposed toner image T(supx) borne on the recording material P is a superimposed toner image T(supx) in which the yellow patch image T(Yh) is superimposed on the top of the black patch image T(Kx).

Figure 14A:
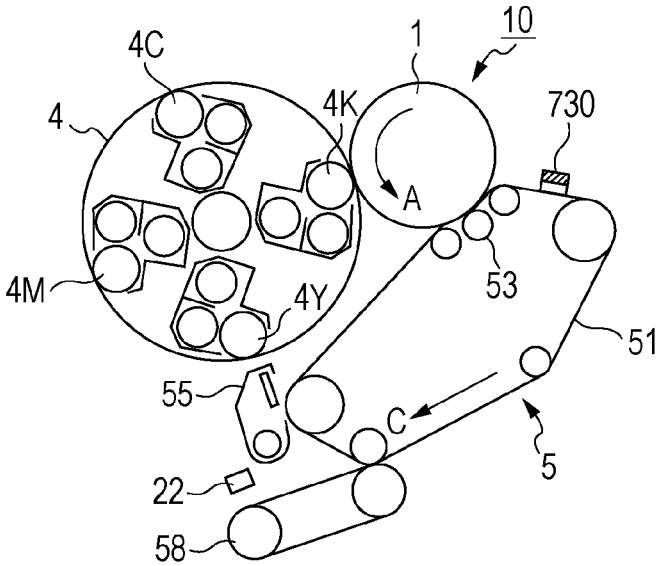
FIGS. 14A and 14B are diagrams illustrating an operation when an image forming apparatus of a second embodiment forms a superimposed toner image.
Figure 14B:
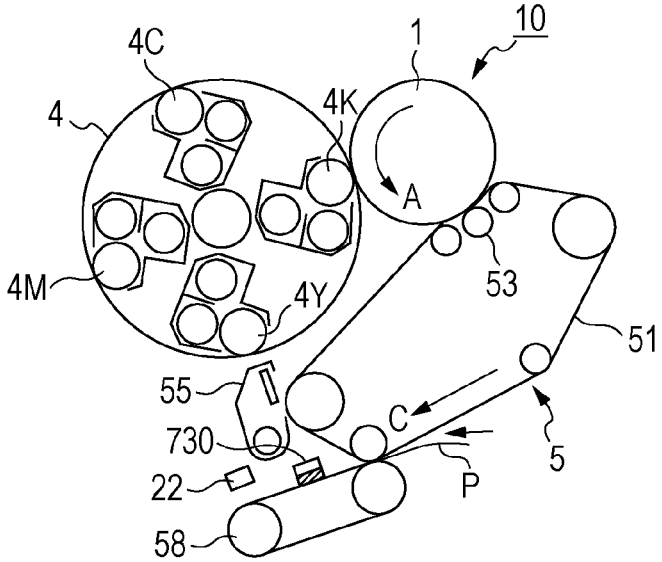

FIGS. 14A and 14B are cross-sectional views of the main part of an image forming apparatus of this embodiment. A method for forming a superimposed toner image will be described using these figures. For ease of description, a black patch image serving as a toner image having a second color is represented by 720, a yellow patch image serving as a reference toner image is represented by 710, and a superimposed toner image is represented by 730.

The yellow patch image 710 formed on the photosensitive drum 1 by the developing unit 4Y is transferred onto the intermediate transfer belt 51 at the primary transfer nip portion, and is then conveyed to the secondary transfer nip portion in accordance with the rotation of the intermediate transfer belt 51 in the arrow C direction. At this time, however, a secondary transfer voltage is not applied to the secondary transfer roller 57 and the secondary transfer opposing roller 56, and the belt cleaner 55 is located away from the intermediate transfer belt 51 in a manner similar to that when a full-color toner image is formed. Therefore, the yellow patch image 710 is again conveyed to the primary transfer nip portion while maintaining the toner height.

Subsequently, the black patch image 720 is formed on the photosensitive drum 1 by the developing unit 4K so as to be superimposed on the yellow patch image 710 that is borne on and conveyed by the intermediate transfer belt 51.

Subsequently, the black patch image 720 is transferred so as to be superimposed on the top of the yellow patch image 710 at the primary transfer nip portion, and therefore the superimposed toner image 730 is formed (FIG. 14A). The superimposed toner image 730 is conveyed to the secondary transfer nip portion in accordance with the rotation of the intermediate transfer belt 51 in the arrow C direction. At this timing, the recording material P, which has been conveyed by the paper feed rollers 71 and 72 from inside the paper feed cassette 7 and whose position and delivery timing have been adjusted by the registration roller 73, is conveyed to the secondary transfer nip portion.

When the superimposed toner image 730 and the recording material P enter the secondary transfer nip portion, a secondary transfer voltage is applied to the secondary transfer roller 57 and the secondary transfer opposing roller 56, and the superimposed toner image 730 is transferred onto the recording material P (FIG. 14B). The recording material P and the superimposed toner image 730 borne on the recording material P are conveyed to the irradiation position of the toner height sensor unit 22 in accordance with the rotation of the conveyor belt 58, and the light intensities D(0) and D(3) are measured by the toner height sensor unit 22. Thereafter, the recording material P and the superimposed toner image 730 borne on the recording material P are conveyed to the fixing device 9, and the superimposed toner image 730 is fixed onto the recording material P.

Since the surface of the superimposed toner image 730 conveyed to the irradiation position of the toner height sensor unit 22 is the yellow toner (yellow patch image 710), it is possible to accurately detect the light receiving position P(3) of light reflected off the superimposed toner image 730.

The toner height of the superimposed toner image 730 is equal to the sum of the toner height of the black patch image 720 and the toner height of the yellow patch image 710. That is, the light receiving position difference ΔP(2) of the black patch image 720 is measured at a light receiving position where the light receiving position of light reflected off the surface of the superimposed toner image 730 changes from the light receiving position of light reflected off the yellow patch image 710 by an amount corresponding to the toner height of the black patch image.

Thus, the light receiving position difference ΔP(2) of the black patch image can be calculated using Formula 5 from the light receiving position ΔP(3) of light reflected off the superimposed toner image 730 and the light receiving position ΔP(1) of light reflected off the yellow patch image 710. The light receiving position difference ΔP(1) of light reflected off the yellow patch image 710 is calculated from the light receiving position P(1) detected from the light intensity D(1) of a yellow patch image 710, which has been separately transferred onto the recording material P in a single-color state, and the light receiving position P(0) of the recording material P.

The black image forming conditions are controlled in a manner similar to that in the first embodiment on the basis of the light receiving position difference ΔP(2) of the black patch image calculated in the above manner.

Here, the image forming conditions are a charging voltage, a developing bias, a lookup table, a primary transfer voltage, a secondary transfer voltage, and so on. Control of the image forming conditions is similar to existing density control, and the detailed descriptions thereof are omitted.

Third Embodiment

The basic configuration of this embodiment is the same as that of the first embodiment. Thus, components that are the same as or substantially the same as those of the first embodiment are assigned the same numerals, the detailed description of which is omitted, and portions that are features of this embodiment will be described.

In the first and second embodiments, a superimposed toner image is formed using an image forming apparatus that includes one photosensitive drum and developing units of respective colors. In this embodiment, a superimposed toner image is formed using an image forming apparatus that includes photosensitive drums and a plurality of developing units each corresponding to one of the photosensitive drums.

Figure 15:
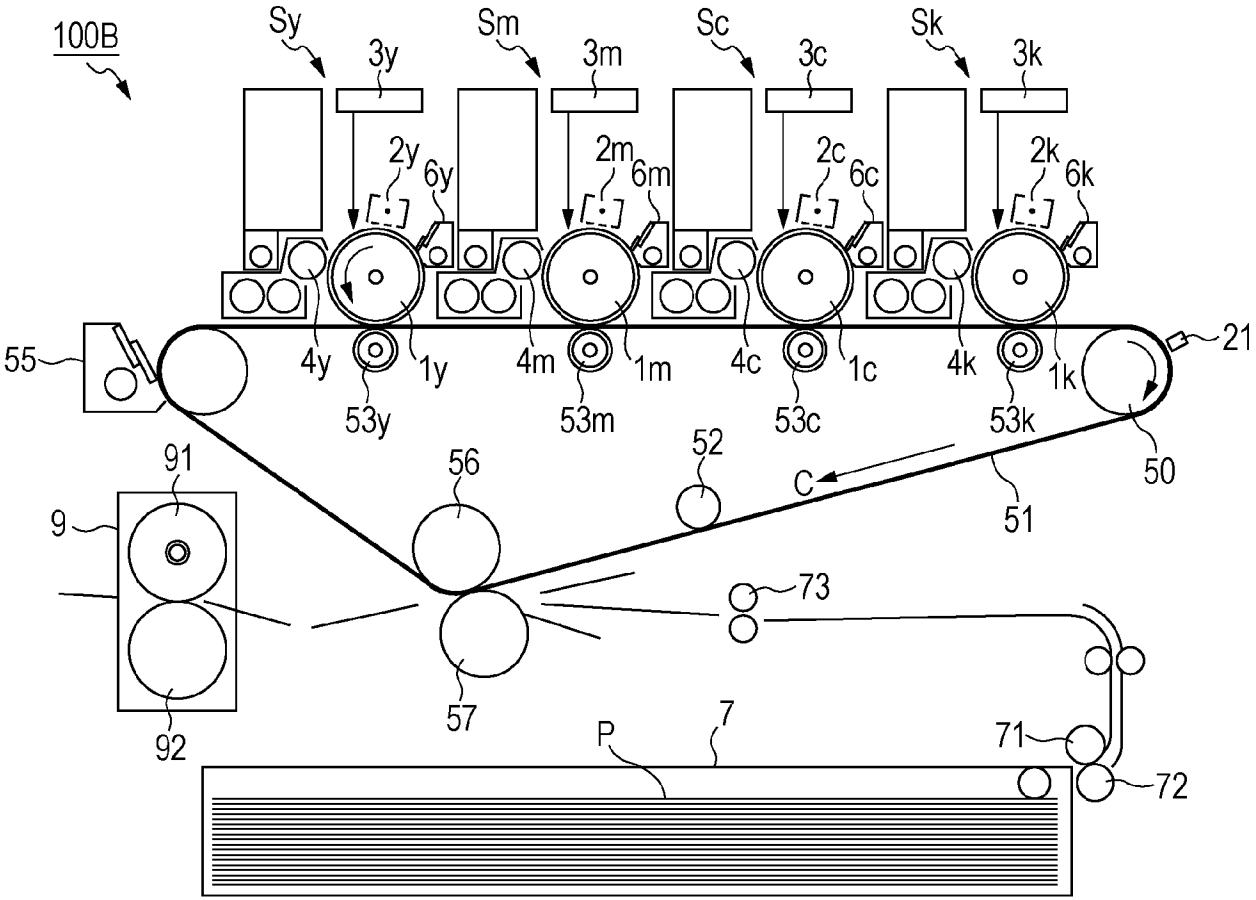
FIG. 15 is a schematic cross-sectional view illustrating an image forming apparatus of a third embodiment.

FIG. 15 is a schematic cross-sectional view of a printer unit 100B of this embodiment.

An image forming apparatus 100 of this embodiment includes image forming units Sy, Sm, Sc, and Sk serving as image forming units that form toner images of the respective colors. Here, Sy denotes an image forming unit that forms a yellow toner image, Sm denotes an image forming unit that forms a magenta toner image, Sc denotes an image forming unit that forms a cyan toner image, and Sk denotes an image forming unit that forms a black toner image.

The printer unit 100B of this embodiment is configured such that yellow, magenta, cyan, and black toner images formed using the image forming units Sy, Sm, Sc, and Sk are transferred onto an intermediate transfer belt 51 serving as an image bearing member so as to be sequentially superimposed on one another to form a full-color toner image. When the full-color toner image borne on the intermediate transfer belt 51 is conveyed to the secondary transfer nip portion, the full-color toner image is transferred onto the recording material P that is conveyed from the paper feed cassette 7 at this timing, and is fixed as a full-color image using a fixing device 9.

More specifically, when an image forming operation is executed, photosensitive drums 1*y*, 1*m*, 1*c*, and 1*k* that are driven to rotate at a predetermined speed are uniformly charged by corona chargers 2*y*, 2*m*, 2*c*, and 2*k*. Subsequently, when exposure devices 3*y*, 3*m*, 3*c*, and 3*k* expose the photosensitive drums 1*y*, 1*m*, 1*c*, and 1*k* to light on the basis of laser output signals subjected to color separation in accordance with an original document, the photosensitive drums 1*y*, 1*m*, 1*c*, and 1*k* have formed thereon electrostatic latent images corresponding to images of the respective colors.

Subsequently, the electrostatic latent image corresponding to the yellow image formed on the photosensitive drum 1*y* is developed as a yellow toner image by the developing unit 4*y* to which a developing bias has been applied. The yellow toner image is transferred onto the intermediate transfer belt 51 by applying a primary transfer voltage to a primary transfer roller 53*y* at a primary transfer nip portion where the primary transfer roller 53*y* presses against the photosensitive drum 1*y* with the intermediate transfer belt 51 therebetween. The intermediate transfer belt 51 is stretched by a drive roller 50, a secondary transfer opposing roller 56, and a tension roller 52, and is driven to rotate in the arrow C direction by the rotational driving of the drive roller 50.

The yellow toner image borne on the intermediate transfer belt 51 is conveyed to a primary transfer nip portion, where a primary transfer roller 53*m* presses against the photosensitive drum 1*m* with the intermediate transfer belt 51 therebetween, in accordance with the rotation of the intermediate transfer belt 51 in the arrow C direction. Then, also in the image forming unit Sm, the magenta toner image formed on the photosensitive drum 1*m* is transferred so as to be superimposed on the top of the yellow toner image on the intermediate transfer belt 51 by applying a primary transfer voltage.

Subsequently, likewise, when the cyan and black toner images are transferred so as to be sequentially superimposed on the superimposed toner image of the yellow and magenta toner images on the intermediate transfer belt 51, a full-color toner image is formed on the intermediate transfer belt 51. The full-color toner image is transferred onto a recording material P, which is conveyed from the paper feed cassette 7 at a synchronized time, at a secondary transfer nip portion where the secondary transfer opposing roller 56 presses against the secondary transfer roller 57 with the intermediate transfer belt 51 therebetween.

Residual toner that is not transferred onto the intermediate transfer belt 51 and that still remains on the photosensitive drums 1*y*, 1*m*, 1*c*, and 1*k* is removed by drum cleaners 6*y*, 6*m*, 6*c*, and 6*k* in accordance with the rotation of the photosensitive drums 1*y*, 1*m*, 1*c*, and 1*k*. Further, residual toner that is not transferred onto the recording material P and that still remains on the intermediate transfer belt 51 is removed by a belt cleaner 55 in accordance with the rotation of the intermediate transfer belt 51.

The full-color toner image transferred onto the recording material P is conveyed to the fixing device 9 by a conveying roller (not illustrated). In the fixing device 9, the full-color toner image and the recording material P, while being held between and conveyed by fixing rollers 91 and 92, are heated by a heater (not illustrated) provided in the fixing roller 91, thus allowing the full-color toner image to be fixed onto the recording material P.

Next, the operation of the image forming apparatus 100 of this embodiment that performs density control using patch images will be described. A toner image having a first color in this embodiment is a yellow patch image T(ref) formed under predetermined image forming conditions using the image forming unit Sy serving as a first image forming unit, and the photosensitive drum 1*y* is a first photosensitive member. Further, a toner image having a second color in this embodiment is a black patch image T(Kx) formed using the image forming unit Sk serving as a second image forming unit, and the photosensitive drum 1*k* is a second photosensitive member.

When density control is started, the printer unit 100B of this embodiment forms patch images T(Yx), T(Mx), T(Cx), and T(Kx) on the photosensitive drums 1*y*, 1*m*, 1*c*, and 1*k*, respectively, on the basis of the image forming conditions stored in the ROM 130 or the RAM 132. Subsequently, the patch images T(Yx), T(Mx), T(Cx), and T(Kx) borne on the photosensitive drums 1*y*, 1*m*, 1*c*, and 1*k* are transferred onto the intermediate transfer belt 51 at the respective primary transfer nip portions. In this case, black, cyan, magenta, and yellow patch images are borne on the intermediate transfer belt 51 in this order toward the upstream in the rotation direction of the intermediate transfer belt 51 from the irradiation position of the toner height sensor unit 21.

The patch images T(Yx), T(Mx), T(Cx), and T(Kx) borne on the intermediate transfer belt 51 are sequentially conveyed to the irradiation position of the toner height sensor unit 21 in accordance with the rotation of the intermediate transfer belt 51 in the arrow C direction. The toner height sensor unit 21 radiates measurement light to the yellow, magenta, and cyan patch images T(Yx), T(Mx), and T(Cx) conveyed to the irradiation position, and detects the light receiving positions P(Yx), P(Mx), and P(C) of light reflected off the respective patch images. In this case, the light receiving position P(Kx) of light reflected off the black patch image is not detected.

The printer unit 100B of this embodiment is configured such that the yellow image forming unit Sy, the black image forming unit Sk, and the toner height sensor unit 21 are disposed in this order from the upstream in the rotation direction (arrow C direction) of the intermediate transfer belt 51. Thus, in order to form a superimposed toner image T(supx), it is necessary to convey the black patch image T(Kx) to the primary transfer nip portion of the yellow image forming unit Sy where the primary transfer roller 53*y* presses against the photosensitive drum 1*y* with the intermediate transfer belt 51 therebetween.

Accordingly, this embodiment has a configuration in which the belt cleaner 55 can be brought close to or away from the intermediate transfer belt 51 so as not to remove the black patch image T(Kx).

A secondary transfer voltage is not applied to the secondary transfer roller 57 and the secondary transfer opposing roller 56 of this embodiment when the yellow, magenta, cyan, and black patch images T(Yx), T(Mx), T(Cx), and T(Kx) are conveyed to the secondary transfer nip portion. Further, the belt cleaner 55 is brought away from the intermediate transfer belt 51 until the black patch image T(Kx) becomes the superimposed toner image T(supx) in the yellow image forming unit Sy.

Therefore, the black patch image T(Kx) is conveyed to the primary transfer nip portion of the yellow image forming unit Sy while maintaining the toner height.

The black patch image T(Kx) borne on the intermediate transfer belt 51 is transferred in such a manner that the yellow patch image T(ref) formed under predetermined image forming conditions is superimposed on the black patch image T(Kx) at the primary transfer nip portion of the yellow image forming unit Sy, and a superimposed toner image T(supx) is produced. The superimposed toner image T(supx) borne on the intermediate transfer belt 51 is again conveyed to the irradiation position of the toner height sensor unit 21 in accordance with the rotation of the intermediate transfer belt 51 in the arrow C direction, and the light receiving position P(supx) is detected by using the toner height sensor unit 21.

Similarly to the first embodiment, the toner height sensor unit 21 also detects the light receiving position P(0) of light reflected off the intermediate transfer belt 51 when detecting the light receiving positions of light reflected off the patch images T(Yx), T(Mx), and T(Cx) and reflected off the superimposed toner image T(supx).

Subsequently, respective light receiving position differences ΔP(Yx), ΔP(Mx), ΔP(Cx), and ΔP(Kx) are calculated from the light receiving positions P(0), P(Yx), P(Mx), P(Cx), and P(supx) detected by the toner height sensor unit 21 using the method described above. Similarly to the first embodiment, the yellow, magenta, and cyan image forming conditions are controlled on the basis of the light receiving position differences ΔP(Yx), ΔP(Mx), and ΔP(Cx) of the yellow, magenta, and cyan patch images.

Further, the light receiving position difference ΔP(Kx) of the black patch image is calculated from the difference between the light receiving position difference ΔP(supx) of the superimposed toner image and a light receiving position difference ΔP(ref) of a yellow patch image formed under the predetermined image forming conditions. Here, the light receiving position difference ΔP(ref) of the yellow patch image formed under the predetermined image forming condition can be detected from a light receiving position P(ref) of light reflected off a yellow patch image separately measured in a single state.

Here, the image forming conditions are a charging voltage, a developing bias, a lookup table, a primary transfer voltage, and so on. Control of the image forming conditions is similar to existing density control, and the detailed descriptions thereof are omitted.

Further, the image forming apparatus 100 of this embodiment may be configured to detect the amounts of adhering toner of the respective colors from the light receiving position differences ΔP(Yx), ΔP(Mx), and ΔP(Cx) of the yellow, magenta, and cyan patch images and the light receiving position difference ΔP(Kx) of the black patch image. With this configuration, the amounts of adhering toner of the respective colors may be detected from the light receiving position differences ΔP(Yx), ΔP(Mx), ΔP(Cx), and ΔP(Kx) of the patch images of the respective colors using the table described above representing a correspondence relationship between a light receiving position difference and an amounts of adhering toner. Another configuration may also be used in which densities of patch images of respective colors are detected from the amounts of adhering toner of the patch images of the respective colors using a table representing a correspondence relationship between an amount of adhering toner and a density.

Fourth Embodiment

This embodiment is different from the third embodiment described above in terms of the following points. Other elements in this embodiment are the same as the corresponding ones in the third embodiment described above, and the descriptions thereof are omitted.

In the image forming apparatus of the third embodiment, it is necessary to rotate the intermediate transfer belt 51 one or more turns from when a black patch image is transferred onto the intermediate transfer belt 51 to when the light receiving position of a superimposed toner image is detected. In an image forming apparatus of this embodiment, however, the light receiving position of the superimposed toner image can be detected before the intermediate transfer belt 51 is rotated one turn.

Figure 16:
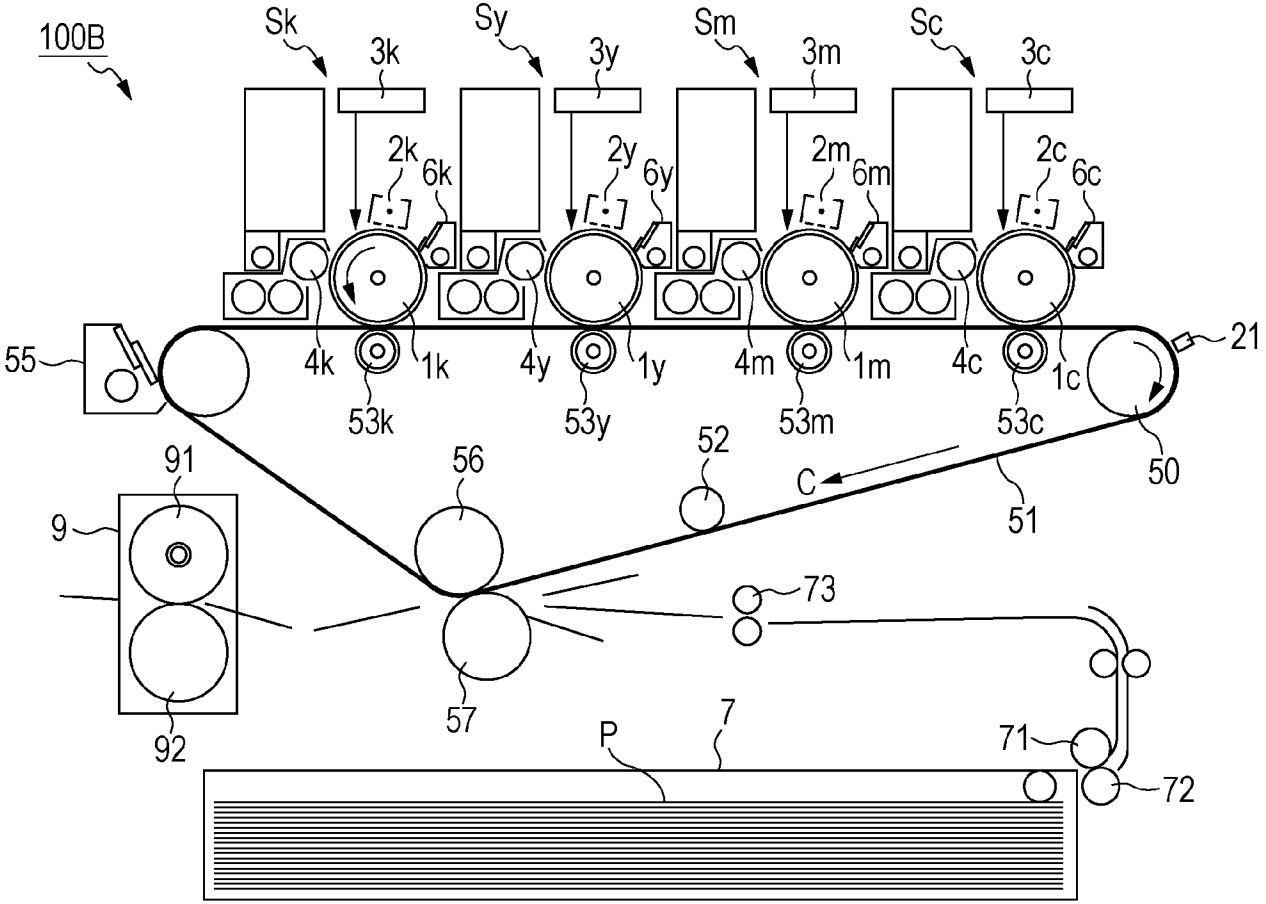
FIG. 16 is a schematic cross-sectional view illustrating an image forming apparatus of a fourth embodiment.

FIG. 16 is a schematic cross-sectional view of a printer unit 100B of this embodiment.

The printer unit 100B in the image forming apparatus 100 of this embodiment is configured such that a black image forming unit Sk, a yellow image forming unit Sy, and a toner height sensor unit 21 are disposed in this order from the upstream in the rotation direction (arrow C direction) of the intermediate transfer belt 51.

Next, the operation of the image forming apparatus 100 of this embodiment that performs density control using patch images will be described. In this embodiment, a reference toner image having a first color is a yellow patch image formed under predetermined image forming conditions, and further a toner image having a second color is a black patch image.

When density control is started, in the printer unit 100B of this embodiment, patch images T(Kx), T(Yx), T(Mx), and T(Cx) formed on the basis of the image forming conditions stored in the ROM 130 or the RAM 132 are borne on the intermediate transfer belt 51. In this case, cyan, magenta, yellow, and black patch images are borne on the intermediate transfer belt 51 in this order toward the upstream in the rotation direction of the intermediate transfer belt 51 from the irradiation position of the toner height sensor unit 21.

The black patch image T(Kx) borne on the intermediate transfer belt 51 is conveyed to the primary transfer nip portion of the yellow image forming unit Sy before being conveyed to the irradiation position of the toner height sensor unit 21 in accordance with the rotation of the intermediate transfer belt 51 in the arrow C direction. In this case, the yellow image forming unit Sy forms a yellow patch image formed under predetermined image forming conditions on the photosensitive drum 1*y* in such a manner that the yellow patch image is superimposed on the black patch image T(Kx) borne on the intermediate transfer belt 51. Subsequently, the yellow image forming unit Sy transfers the yellow patch image T(ref)

formed under the predetermined image forming conditions so as to be superimposed on the black patch image T(Kx), and forms a superimposed toner image T(supx).

Subsequently, the superimposed toner image T(supx) and the yellow, magenta, and cyan patch images T(Yx), T(Mx), and T(Cx) borne on the intermediate transfer belt 51 are conveyed to the irradiation position of the toner height sensor unit 21 in accordance with the rotation of the intermediate transfer belt 51 in the arrow C direction.

The toner height sensor unit 21 radiates measurement light to the patch images T(Yx), T(Mx), and T(Cx) and the superimposed toner image T(supx) sequentially conveyed to the irradiation position and the intermediate transfer belt 51 bearing the above images. Therefore, the light receiving positions P(Yx), P(Mx), and P(Cx) of light reflected off the yellow, magenta, and cyan patch images, the light receiving position P(supx) of light reflected off the superimposed toner image, and the light receiving position P(0) of light reflected off the intermediate transfer belt 51 are detected.

The image forming apparatus 100 of this embodiment calculates the respective light receiving position differences ΔP(Yx), ΔP(Mx), ΔP(Cx), and ΔP(Kx) using the method described above from the light receiving positions P(Yx), P(Mx), P(Cx), P(supx), and P(0) detected by the toner height sensor unit 21. Similarly to the first embodiment, the yellow, magenta, and cyan image forming conditions are controlled on the basis of the light receiving position differences ΔP(Yx), ΔP(Mx), and ΔP(Cx) of the yellow, magenta, and cyan patch images.

Further, the light receiving position difference ΔP(Kx) of the black patch image is calculated from the difference between the light receiving position difference ΔP(supx) of light reflected off the superimposed toner image and the light receiving position difference ΔP(ref) of the yellow patch image formed under the predetermined image forming conditions. Here, the light receiving position difference ΔP(ref) of the yellow patch image formed under the predetermined image forming conditions can be calculated from the light receiving position of light reflected off a yellow patch image T(ref) separately measured in a single state.

Here, the image forming conditions are a charging voltage, a developing bias, a lookup table, a primary transfer voltage, and so on. Control of the image forming conditions is similar to existing density control, and the detailed descriptions thereof are omitted.

Further, the image forming apparatus 100 of this embodiment may be configured to detect the amounts of adhering toner of the respective colors from the light receiving position differences ΔP(Yx), ΔP(Mx), and ΔP(Cx) of the yellow, magenta, and cyan patch images and the light receiving position difference ΔP(Kx) of the black patch image. With this configuration, the amounts of adhering toner of patch images of the respective colors may be detected from the light receiving position differences ΔP(Yx), ΔP(Mx), ΔP(Cx), and ΔP(Kx) of the respective color components using the table described above representing a correspondence relationship between a light receiving position difference and an amount of adhering toner. Another configuration may also be used in which densities of patch images of respective colors are detected from the amounts of adhering toner of the patch images of the respective colors using a table representing a correspondence relationship between an amount of adhering toner and a density.

According to this embodiment, the black patch image has already been borne on the intermediate transfer belt 51 as a superimposed toner image at the time when the black patch image passes through the irradiation position of the toner height sensor unit 21 in accordance with the rotation of the intermediate transfer belt 51 in the arrow C direction. That is, the black patch image in a single state is not conveyed to the position where the belt cleaner 55 removes the toner remaining on the intermediate transfer belt 51 in accordance with the rotation of the intermediate transfer belt 51 in the arrow C direction. Thus, unlike the third embodiment, there is no need for the belt cleaner 55 to be configured to be capable of being brought close to or away from the intermediate transfer belt 51, and therefore the downtime required to detect a light receiving position can be made shorter than that in the image forming apparatus of the third embodiment.

Further, in the first to fourth embodiments, a superimposed toner image is formed by superimposing a yellow patch image serving as a reference toner image having a first color on a black patch image serving as a toner image having a second color. However, the combination of a reference toner image having a first color and a toner image having a second color is not limited to that in the above configuration. In this embodiment, the measurement light radiated from the laser oscillator 701 has a wavelength of 780 [nm]. If the wavelength of the measurement light is 680 [nm], the reflectance for cyan (FIG. 6C) is approximately 10 [%] and the light amount of light reflected off a cyan patch image is reduced. Thus, a configuration may be used in which a superimposed toner image is formed by superimposing a magenta patch image on a cyan patch image and in which the light receiving position difference of the cyan patch image is indirectly detected. That is, any configuration may be used if a toner image having a first color is composed of toner having a higher reflectance color than that of a toner image having a second color.

Further, while in the first to fourth embodiments, a first toner image to be superimposed on a toner image of a second color is a reference toner image T(ref), the toner image of the first color is not limited to that in this configuration. More preferably, the toner image of the first color may have a density level to which the corresponding toner is piled up so as to uniformly cover the underlying portion such as the intermediate transfer belt 51 or the recording material P. With this configuration, a superimposed toner image T(supx) in which a toner image of a first color is superimposed on a toner image of a second color has a surface covered with the toner of the first color. Thus, measurement light radiated from the laser oscillator 701 is reflected off the surface of the superimposed toner image T(supx), which is covered with the toner of the first color, resulting in an increase in the amount of reflected light received by the line sensor 704 and accurate detection of the light receiving position P(supx) of the superimposed toner image T(supx).

Further, the first to fourth embodiments have a configuration in which image forming conditions are controlled, based on light receiving position differences of patch images of respective colors, from the difference between light receiving position differences and target values. However, control of image forming conditions is not limited to that in the above configuration, and a configuration may be used in which the image forming conditions are controlled from light receiving position differences of patch images of respective colors on the basis of amounts of adhering toner converted using a table representing a correspondence relationship between a light receiving position difference and an amount of adhering toner stored in advance in the ROM 130. Alternatively, a configuration may also be used in which the image forming conditions are controlled from amounts of adhering toner of patch images of respective colors on the basis of densities converted using a table representing the correspondence relationship between the amounts of adhering toner of the respective color components and densities stored in advance in the ROM 130.

Further, in the first to fourth embodiments, in order to form a superimposed toner image T(supx), a toner image of a first color to be superimposed on a toner image of a second color is a reference toner image T(ref), and a light receiving position difference corresponding to the toner height of the toner image of the first color is controlled to be equal to a target value. That is, the first toner image is formed under the completely same image forming conditions as those for the reference toner image so that the light receiving position difference of the first toner image can be equal to the light receiving position difference (target value) of the reference toner image. However, the image forming conditions of the toner image of the first color are not limited to those in the above configuration. The toner image of the first color may be configured to be formed under the image forming conditions that are completely the same as or equivalent to those within the range that allows the same height as that of the reference toner image T(ref) to be obtained.

Further, a toner image of a first color to be superimposed on a toner image of a second color in order to form a superimposed toner image T(supx) is not limited to that in the configuration in which image forming conditions for forming the toner image of the first color are controlled so that the light receiving position difference corresponding to the toner height of the toner image of the first color can be equal to a target value.

In a case where the above configuration is used, the following configuration may be used: A plurality of toner images of the first color are formed, and a toner image of the first color having the light receiving position difference closest to a target value from among the light receiving position differences corresponding to the toner heights of the toner images of the first color is specified. Subsequently, a toner image of the first color formed under image forming conditions that provide the light receiving position difference closest to the target value is superimposed on a toner image of a second color and a superimposed toner image T(supx) is formed.

Further, in the first to fourth embodiments, a reference toner image T(ref) borne on the intermediate transfer belt 51 or on the recording material P is a toner image of a first color to be superimposed on a toner image of a second color when a superimposed toner image T(supx) is formed. However, any other configuration may be used. The following configuration may also be used: A light receiving position difference corresponding to the toner height of the reference toner image T(ref) is detected by the toner height sensor unit 21, and the correspondence relationship between the image forming conditions and the toner heights is specified. Subsequently, on the occasion of formation of a superimposed toner image T(supx), a toner image of a first color is formed under image forming conditions that allow the toner height to be N times the toner height of the reference toner image T(ref), and is superimposed on a toner image of a second color. The term N times may be twice, three times, one-third times, or one-quarter times. Furthermore, a configuration may also be used in which a superimposed toner image T(supx) is formed by forming a toner image of a first color under image forming conditions that allow, instead of the toner height, the light receiving position difference to be N times and superimposing the toner image of the first color on a toner image of a second color.

In the first to fourth embodiments, a light receiving position corresponding to the toner height of a toner image of a second color is detected from the difference between the light receiving position difference of the reference toner image T(ref) and the light receiving position difference of the superimposed toner image T(supx). Here, the term light receiving position difference of the reference toner image T(ref) is the difference between the light receiving position of reflected light from the reference toner image T(ref) and the light receiving position of reflected light from the intermediate transfer belt 51. Further, the term light receiving position difference of the superimposed toner image T(supx) is the difference between the light receiving position of reflected light from the superimposed toner image T(supx) and the light receiving position of reflected light from the intermediate transfer belt 51. However, if the light receiving position of reflected light off the intermediate transfer belt 51 is specified in advance, a configuration may be used in which the light receiving position corresponding to the toner height of a toner image of a second color is detected from the difference between the light receiving position of the reference toner image T(ref) and the light receiving position of the superimposed toner image T(supx).

According to the present invention, it is possible to accurately detect the density of even a high-density patch image formed of low-reflectance toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2009/071709, filed Dec. 26, 2009, which is hereby incorporated by reference herein in its entirety.

REFERENCE SIGNS LIST

T(ref) reference toner image (yellow patch image T(Yh) having a density level of 127)
T(Kx) black patch image
T(supx) superimposed toner image
51 intermediate transfer belt
701 laser oscillator
704 line sensor
128 CPU

What is claimed is:

1. An image forming apparatus comprising:

an image forming unit configured to form a reference toner image having a first color, and a superimposed toner image in which a toner image of the first color is superimposed on the top of a toner image having a second color with a lower reflectance than the first color, the toner image of the first color being formed under a predetermined condition under which a toner height with respect to that of the reference toner image is specified;

an image bearing member configured to bear the reference toner image and the superimposed toner image that are formed by the image forming unit;

an output unit configured to output a first signal corresponding to the toner height of the reference toner image formed by the image forming unit and a second signal corresponding to the toner height of the superimposed toner image formed by the image forming unit; and a toner density detecting unit configured to detect the density of the toner image having the second color included in the superimposed toner image in accordance with a difference between the first signal and the second signal output from the output unit.

2. An image forming apparatus comprising:

an image forming unit configured to form a reference toner image having a first color, and a superimposed toner image in which a toner image of the first color is superimposed on the top of a toner image having a second color with a lower reflectance than the first color, the toner image of the first color being formed under a predetermined condition under which a toner height with respect to that of the reference toner image is specified;

an image bearing member configured to bear the reference toner image and the superimposed toner image that are formed by the image forming unit;

an output unit configured to output a first signal corresponding to the toner height of the reference toner image formed by the image forming unit and a second signal corresponding to the toner height of the superimposed toner image formed by the image forming unit; and a height detecting unit configured to detect the toner height of the toner image having the second color included in the superimposed toner image in accordance with a difference between the first signal and the second signal output from the output unit.

3. An image forming apparatus comprising:

an image forming unit configured to form a reference toner image having a first color, and a superimposed toner image in which a toner image of the first color is superimposed on the top of a toner image having a second color with a lower reflectance than the first color, the toner image of the first color being formed under a predetermined condition under which a toner height with respect to that of the reference toner image is specified;

an image bearing member configured to bear the reference toner image and the superimposed toner image that are formed by the image forming unit;

an output unit configured to output a first signal corresponding to the toner height of the reference toner image formed by the image forming unit and a second signal corresponding to the toner height of the superimposed toner image formed by the image forming unit; and a control unit configured to control an image forming condition under which the image forming unit forms a toner image using toner of the second color, in accordance with a difference between the first signal and the second signal output from the output unit.

4. The image forming apparatus acceding to claim 3, wherein:

the output unit includes an irradiation unit configured to radiate light to the image bearing member, and includes a light receiving unit configured to output the first signal corresponding to the toner height of the reference toner image by receiving light radiated to the reference toner image from the irradiation unit and to output the second signal corresponding to the toner height of the superimposed toner image by receiving light radiated to the superimposed toner image from the irradiation unit.

5. The image forming apparatus according to claim 4, wherein:

the light receiving unit outputs the first signal by receiving light radiated from the irradiation unit and reflected from the reference toner image, and outputs the second signal by receiving light radiated from the irradiation unit and reflected from the superimposed toner image.

6. The image forming apparatus according to claim 5, wherein:

the light receiving unit has a light receiving surface configured to receive light reflected from the reference toner image and to receive light reflected from the superimposed toner image; and the light receiving unit outputs the first signal by receiving by the light receiving unit the light reflected from the reference toner image, the first signal corresponding to an intensity distribution of the light received on the light receiving surface, and outputs the second signal by receiving by the light receiving unit the light reflected from the superimposed toner image, the second signal corresponding to an intensity distribution of the light received on the light receiving surface.

7. The image forming apparatus according to claim 6, wherein:

the control unit controls the image forming condition under which the image forming unit forms a toner image using toner of the second color, in accordance with a difference between a first position on the light receiving surface at which the intensity distribution of the light received by the light receiving surface is maximum, the first position being specified from the first signal output from the light receiving unit, and a second position on the light receiving surface at which the intensity distribution of the light received by the light receiving surface is maximum, the second position being specified from the second signal output from the light receiving unit.

8. The image forming apparatus according to claim 6, wherein:

the control unit controls the image forming condition under which the image forming unit forms a toner image using toner of the second color, in accordance with a difference between a first position on the light receiving surface that serves as a center of gravity position of the light received by the light receiving surface, the first position being specified from the first signal output from the light receiving unit, and a second position of the light receiving surface that serves as a center of gravity position of the light received by the light receiving surface, the second position being specified from the second signal output from the light receiving unit.

9. The image forming apparatus according to claim 6, wherein:

the light receiving surface of the light receiving unit includes a plurality of light receiving elements arranged in a predetermined direction; and the light receiving unit outputs the first signal by receiving by the light receiving unit the light reflected from the reference toner image, the first signal corresponding to a position of a light receiving element at which the intensity distribution of the light received on the light receiving surface is maximum, and outputs the second signal by receiving by the light receiving unit the light reflected from the superimposed toner image, the second signal corresponding to a position of a light receiving element at which the intensity distribution of the light received on the light receiving surface is maximum.

10. The image forming apparatus according to claim 4, wherein:

the image forming unit includes a first image forming unit configured to form an image using toner of the first color, and a second image forming unit configured to form an image using toner of the second color; and the first image forming unit forms a toner image of the first color on the image bearing member at a position that is downstream, in a moving direction of the image bearing member, of a position at which the second image forming unit forms a toner image of the second color on the image bearing member and that is upstream of a position at which the irradiation unit radiates light to the mage bearing member.

11. The image forming apparatus according to claim 3, wherein:

the toner height of the reference toner image is a height of the reference toner image in a direction perpendicular to a surface of the image bearing member; and the toner height of the superimposed toner image is a height of the superimposed toner image in a direction perpendicular to a surface of the image bearing member.

12. An image forming apparatus comprising:

an image bearing member;

an image forming unit configured to form a toner image on the image bearing member, the toner image includes (a) a reference toner image having a first color and (b) a superimposed toner image in which a first toner image having the first color is superimposed on the top of a second toner image having a second color with a lower reflectance than the first color on the image bearing member;

an irradiation unit configured to radiate light to the image bearing member;

a light-receiving unit configured to receive light reflected from the toner image when the irradiation unit radiated light to the toner image formed on the image bearing member;

an output unit configured to output a signal that depends on a toner height of the toner image based on a result of receiving light by the light-receiving unit; and a toner density detecting unit configured to detect the density of the second toner image having the second color included in the superimposed toner image, based on (i) a first signal output from the output unit based on a result of receiving light reflected from the reference toner image by the light-receiving unit and (ii) a second signal output from the output unit based on a result of receiving light reflected from the superimposed toner image by the light-receiving unit.

13. An image forming apparatus comprising:

an image bearing member;

an image forming unit configured to form a toner image on the image bearing member, the toner image includes (a) a reference toner image having a first color and (b) a superimposed toner image in which a first toner image having the first color is superimposed on the top of a second toner image having a second color with a lower reflectance than the first color on the image bearing member;

an irradiation unit configured to radiate light to the image bearing member;

a light-receiving unit configured to receive light reflected from the toner image when the irradiation unit radiated light to the toner image formed on the image bearing member;

an output unit configured to output a signal that depends on a toner height of the toner image based on a result of receiving light by the light-receiving unit; and a height detecting unit configured to detect the toner height of the second toner image having the second color included in the superimposed toner image based on (i) a first signal output from the output unit based on a result of receiving light reflected from the reference toner image by the light-receiving unit and (ii) a second signal output from the output unit based on a result of receiving light reflected from the superimposed toner image by the light-receiving unit.

14. An image forming apparatus comprising:

an image bearing member;

an image forming unit configured to form, in an image forming mode, a toner image on the image bearing member, said image unit forms, in a measuring mode, (a) a reference toner image having a first color and (b) a superimposed toner image in which a first toner image having the first color is superimposed on the top of a second toner image having a second color with a lower reflectance than the first color on the image bearing member;

an irradiation unit configured to radiate light to the image bearing member;

a light-receiving unit configured to receive a first light reflected from the reference toner image when the irradiation unit radiated light to the reference toner image, and receive a second light reflected from the superimposed toner image when the irradiation unit radiated light to the superimposed toner image;

an output unit configured to output a first signal that depends on a toner height of the reference toner image based on a result of receiving the first light by the light-receiving unit, and output a second signal that depends on a toner height of the superimposed toner image based on a result of receiving the second light by the light-receiving unit; and a control unit configured to control an image forming condition in the image forming mode for the image forming unit to form a toner image having the second color, based on (i) the first signal output from the output unit and (ii) the second signal output from the output unit.

15. The image forming apparatus according to claim 12, wherein the output unit outputs the first signal corresponding to an intensity distribution of the light reflected from the reference toner image, and outputs the second signal corresponding to an intensity distribution of the light reflected from the superimposed toner image.

16. The image forming apparatus according to claim 15, wherein the first signal indicates a first position on the light-receiving unit at which an intensity of the light reflected from the reference toner image is maximum; and wherein the second signal indicates a second position on the light-receiving unit at which an intensity of the light reflected from the superimposed toner image is maximum.

17. The image forming apparatus according to claim 16, wherein the toner density detecting unit detects the density of the second toner image having the second color included in the superimposed toner image according to a difference between the first position on the light-receiving unit and the second position on the light-receiving unit.

18. The image forming apparatus according to claim 13, wherein the output unit outputs the first signal corresponding to an intensity distribution of the light reflected from the reference toner image, and outputs the second signal corresponding to an intensity distribution of the light reflected from the superimposed toner image.

19. The image forming apparatus according to claim 18, wherein the first signal indicates a first position on the light-receiving unit at which an intensity of the light reflected from the reference toner image is maximum; and wherein the second signal indicates a second position on the light-receiving unit at which an intensity of the light reflected from the superimposed toner image is maximum.

20. The image forming apparatus according to claim 19, wherein the height detecting unit detects the toner height of the second toner image having the second color included in the superimposed toner image according to a difference between the first position on the light-receiving unit and the second position on the light-receiving unit.

21. The image forming apparatus according to claim 14, wherein the output unit outputs the first signal corresponding to an intensity distribution of the first light reflected from the reference toner image, and outputs the second signal corresponding to an intensity distribution of the second light reflected from the superimposed toner image.

22. The image forming apparatus according to claim 21, wherein the first signal indicates a first position on the light-receiving unit at which an intensity of the first light reflected from the reference toner image is maximum; and wherein the second signal indicates a second position on the light-receiving unit at which an intensity of the second light reflected from the superimposed toner image is maximum.

23. The image forming apparatus according to claim 22, wherein the control unit controls the image forming condition in the image forming mode according to a difference between the first position on the light-receiving unit and the second position on the light-receiving unit.

24. The image forming apparatus according to claim 12, wherein the light- receiving unit is a line sensor.

25. The image forming apparatus according to claim 13, wherein the light- receiving unit is a line sensor.

26. The image forming apparatus according to claim 14, wherein the light- receiving unit is a line sensor.

27. The image forming apparatus according to claim 12, wherein the image forming unit forms the superimposed toner image so that a toner height of the first toner image having the first color included in the superimposed toner image is equal to a toner height of the reference toner image having the first color.

28. The image forming apparatus according to claim 13, wherein the image forming unit forms the superimposed toner image so that a toner height of the first toner image having the first color included in the superimposed toner image is equal to a toner height of the reference toner image having the first color.

29. The image forming apparatus according to claim 14, wherein the image forming unit forms the superimposed toner image in the measuring mode so that a toner height of the first toner image having the first color included in the superimposed toner image is equal to a toner height of the reference toner image having the first color.

30. The image forming apparatus according to claim 12, wherein the first signal depends on the toner height of the reference toner image in a direction perpendicular to a surface of the image bearing member; and wherein the second signal depends on the toner height of the superimposed toner image in the direction perpendicular to the surface of the image bearing member.

31. The image forming apparatus according to claim 13, wherein the first signal depends on the toner height of the reference toner image in a direction perpendicular to a surface of the image bearing member; and wherein the second signal depends on the toner height of the superimposed toner image in the direction perpendicular to the surface of the image bearing member.

32. The image forming apparatus according to claim 14, wherein the first signal depends on the toner height of the reference toner image in a direction perpendicular to a surface of the image bearing member; and wherein the second signal depends on the toner height of the superimposed toner image in the direction perpendicular to the surface of the image bearing member.

33. The image forming apparatus according to claim 12, wherein:

the image forming unit includes a first image forming unit configured to form a toner image having the first color, and a second image forming unit configured to form a toner image having the second color; and a position of the first image forming unit on the image bearing member is downstream of a position of the second image forming unit on the image bearing member in a moving direction of the image bearing member.

34. The image forming apparatus according to claim 13, wherein:

the image forming unit includes a first image forming unit configured to form a toner image having the first color, and a second image forming unit configured to form a toner image having the second color; and a position of the first image forming unit on the image bearing member is downstream of a position of the second image forming unit on the image bearing member in a moving direction of the image bearing member.

35. The image forming apparatus according to claim 14, wherein:

the image forming unit includes a first image forming unit configured to form a toner image having the first color, and a second image forming unit configured to form a toner image having the second color; and a position of the first image forming unit on the image bearing member is downstream of a position of the second image forming unit on the image bearing member in a moving direction of the image bearing member.

* * * * *